US011273087B1

(12) United States Patent
Mokhtar

(10) Patent No.: US 11,273,087 B1
(45) Date of Patent: Mar. 15, 2022

(54) AUTONOMUS AND USER-INPUT RECONFIGURABLE PRONING BED AND METHOD FOR RECONFIGURING PRONING BED IN THE TREATMENT OF ACUTE RESPIRATORY DISTRESS SYNDROME (ARDS)

(71) Applicant: Tarek Hassan Amin Mokhtar, Riyadh (SA)

(72) Inventor: Tarek Hassan Amin Mokhtar, Riyadh (SA)

( * ) Notice: Subject to any disclaimer, the term of this patent is extended or adjusted under 35 U.S.C. 154(b) by 0 days.

(21) Appl. No.: 17/395,847

(22) Filed: Aug. 6, 2021

(51) Int. Cl.

| | |
|---|---|
| ***A61G 7/005*** | (2006.01) |
| ***A61G 7/015*** | (2006.01) |
| ***A61G 7/018*** | (2006.01) |
| ***A61G 7/07*** | (2006.01) |
| ***A61G 7/075*** | (2006.01) |
| ***A61G 13/02*** | (2006.01) |
| ***A61G 13/04*** | (2006.01) |
| ***A61G 13/08*** | (2006.01) |
| ***A61G 7/10*** | (2006.01) |

(52) U.S. Cl.
CPC ..... *A61G 7/005* (2013.01); *A61G 7/015* (2013.01); *A61G 7/018* (2013.01); *A61G 7/072* (2013.01); *A61G 7/075* (2013.01); *A61G 7/1084* (2013.01); *A61G 7/1092* (2013.01); *A61G 7/1096* (2013.01); *A61G 13/02* (2013.01); *A61G 13/04* (2013.01); *A61G 13/08* (2013.01); *A61G 2200/325* (2013.01); *A61G 2203/16* (2013.01); *A61G 2203/32* (2013.01); *A61G 2203/42* (2013.01); *A61G 2210/00* (2013.01)

(58) Field of Classification Search
CPC ..... A61G 7/005; A61G 7/012; A61G 7/015; A61G 7/018; A61G 13/02; A61G 13/04; A61G 13/06; A61G 13/08; A61G 7/072; A61G 7/065; A61G 7/07; A61G 7/075; A61G 7/0755; A61G 7/1092; A61G 7/1082; A61G 7/1084; A61G 7/1086; A61G 7/1096; A61G 2200/325; A61G 2203/16; A61G 2203/32; A61G 2203/42; A61G 2210/00
USPC ..... 5/610, 600, 611, 612, 621–624
See application file for complete search history.

(56) References Cited

U.S. PATENT DOCUMENTS

| | | | |
|---|---|---|---|
| 3,993,051 | A | 11/1976 | Maruyama |
| 5,103,516 | A | 4/1992 | Stevens |
| 5,230,113 | A | 7/1993 | Foster et al. |

(Continued)

*Primary Examiner* — Robert G Santos
(74) *Attorney, Agent, or Firm* — Ellenoff Grossman & Schole LLP; James M. Smedley; Alex Korona

(57) ABSTRACT

There is provided a reconfigurable autonomous and user-input proning bed. The proning bed includes controllers and at least one of: a head position system (HPS) to detect a position of the head of the patient configurable and reconfigurable to be automatically positioned; an arms position system (APS) to detect the presence of the arms of the patient and change a level and inclination of APS upper sections and APS lower sections; a legs position system (LPS) to detect the presence of the legs of the patient and change a level and inclination of LPS upper sections and LPS lower sections; and a body position system (BPS) to detect the presence of the torso of the patient and change a level and inclination of a BPS upper section and a BPS lower section. The proning bed can include an integrated entertainment position system and side rail position system.

16 Claims, 22 Drawing Sheets

(56) References Cited

U.S. PATENT DOCUMENTS 5,704,083 A 1/1998 Nerg
6,282,736 B1 * 9/2001 Hand ..... A61B 6/0428 5/608
6,499,160 B2 * 12/2002 Hand ..... A61G 7/008 5/608
6,566,833 B2 * 5/2003 Bartlett ..... A61G 7/001 318/564
6,671,905 B2 * 1/2004 Bartlett ..... A61G 7/001 128/845
6,691,347 B2 * 2/2004 Hand ..... A61G 13/04 5/607
7,017,211 B2 * 3/2006 Krywiczanin ..... A61G 7/001 5/622
7,219,379 B2 5/2007 Krywiczanin et al.
7,360,266 B2 4/2008 Kasatshko
7,472,440 B2 * 1/2009 Bartlett ..... A61G 7/001 5/607
7,552,733 B1 6/2009 Schubert, III
8,830,069 B2 9/2014 Liu et al.
9,728,061 B2 * 8/2017 Shen ..... A61B 5/1117
9,968,499 B2 5/2018 Davis
10,140,837 B2 * 11/2018 Shen ..... A61B 5/6891
10,258,258 B2 * 4/2019 Larson ..... A61B 5/1114
10,588,565 B2 * 3/2020 Larson ..... A61B 5/024
10,631,732 B2 * 4/2020 Larson ..... G16H 20/30
10,682,076 B2 * 6/2020 Larson ..... A61B 5/6843
10,729,357 B2 * 8/2020 Larson ..... A61B 5/026
10,758,162 B2 * 9/2020 Shen ..... G16H 40/63
10,874,330 B2 * 12/2020 Larson ..... A61B 5/1118
10,888,251 B2 * 1/2021 Larson ..... A61G 7/057
10,912,491 B2 * 2/2021 Shen ..... A61B 5/11
11,051,751 B2 * 7/2021 Larson ..... A61B 5/0205
2002/0026671 A1 * 3/2002 Hand ..... A61H 31/006 5/608
2002/0138905 A1 * 10/2002 Bartlett ..... A61G 7/0513 5/607
2002/0138906 A1 * 10/2002 Bartlett ..... A61G 7/0522 5/609
2003/0115673 A1 * 6/2003 Hand ..... A61H 1/003 5/608
2004/0011779 A1 * 1/2004 Krywiczanin ..... A61G 7/0527 219/217
2004/0226091 A1 * 11/2004 Hand ..... A61B 6/0428 5/601
2006/0162076 A1 * 7/2006 Bartlett ..... A61G 7/0527 5/607
2011/0263950 A1 * 10/2011 Larson ..... G16H 20/00 600/301
2014/0359942 A1 12/2014 Koerth et al.
2015/0254956 A1 * 9/2015 Shen ..... A61B 5/1117 340/573.1
2015/0257952 A1 9/2015 Zerhusen et al.
2016/0256080 A1 * 9/2016 Shen ..... A61B 5/6891
2016/0275776 A1 * 9/2016 Shen ..... A61B 5/1113
2016/0278691 A1 * 9/2016 Larson ..... A61G 7/057
2016/0278692 A1 * 9/2016 Larson ..... G16H 20/10
2016/0296159 A1 * 10/2016 Larson ..... A61B 5/746
2016/0296160 A1 * 10/2016 Larson ..... A61B 5/6801
2016/0302715 A1 * 10/2016 Larson ..... A61B 5/0205
2016/0367170 A1 * 12/2016 Larson ..... G16H 20/40
2017/0027498 A1 * 2/2017 Larson ..... A61B 5/002
2017/0150905 A1 * 6/2017 Shen ..... A61B 5/11
2017/0265781 A1 * 9/2017 Larson ..... A61B 5/002
2017/0325683 A1 * 11/2017 Larson ..... A61B 5/447
2017/0360357 A1 * 12/2017 Larson ..... G16H 20/00
2018/0177659 A1 6/2018 Christensen et al.
2018/0214051 A1 * 8/2018 Larson ..... G16H 70/20
2019/0231228 A1 * 8/2019 Larson ..... A61B 5/1117
2019/0374133 A1 * 12/2019 Shen ..... G08B 21/0453
2020/0178798 A1 * 6/2020 Larson ..... A61B 5/002
2020/0178882 A9 * 6/2020 Larson ..... A61B 5/4866
2020/0214622 A1 * 7/2020 Larson ..... A61B 5/1113
2020/0253475 A1 * 8/2020 Larson ..... A61B 5/1113
2021/0134454 A1 * 5/2021 Larson ..... A61B 5/6801
2021/0330247 A1 * 10/2021 Larson ..... A61B 5/1114

* cited by examiner

AUTONOMUS AND USER-INPUT RECONFIGURABLE PRONING BED AND METHOD FOR RECONFIGURING PRONING BED IN THE TREATMENT OF ACUTE RESPIRATORY DISTRESS SYNDROME (ARDS)

TECHNICAL FIELD

The present disclosure generally relates to patient care beds; and more particularly, the present disclosure relates to an autonomous and user-input reconfigurable proning bed and a method for reconfiguring a proning bed in the treatment of acute respiratory distress syndrome (ARDS) patients.

BACKGROUND

Patients with Acute Respiratory Distress Syndrome (ARDS) face life-threatening lung conditions where the air sacs (alveoli) collect fluids affecting the amount of oxygen reaching the lungs. Thus, causing difficulties in breathing and lack of oxygen supply to the body. It is common for ARDS patients to be directed to the prone position, where it is recommended to lay on the patient's front, i.e., facing down, with the head down or to the side, instead of the common supine position. The benefit of the prone position is that it generally reduces the ventral-dorsal trans-pulmonary pressure difference, reduces lung compression, and improves lung perfusion resulting in better oxygenation and breathing. However, conventional patient beds do not provide sufficient support, comfort, and/or configurability to allow the patient to assume the prone position for extended periods of time.

It is therefore an object of the present invention to provide a reconfigurable proning bed, and a method for reconfiguring a prone bed for helping in the treatment of acute respiratory distress syndrome, in which the above disadvantages are obviated or mitigated, and attainment of desirable attributes is facilitated.

SUMMARY

In an aspect, there is provided a reconfigurable autonomous and user-input proning bed to support and accommodate a patient while positioned in prone position, the reconfigurable proning bed comprising: one or more controllers each comprising one or more processors; and one or more position systems comprising at least one of: a head position system (HPS) comprising one or more HPS sensors to detect a position of the head of the patient and a plurality of actuated pillow components that are configurable and reconfigurable by the one or more controllers to be automatically positioned to accommodate the position of the head of the patient based on the detected position of the head; an arms position system (APS) comprising one or more APS sensors, APS upper sections, and APS lower sections, the one or more APS sensors detect the presence of the arms of the patient, and upon detecting the presence of the arms, a level and inclination of the APS upper sections and the APS lower sections are automatically positioned by the one or more controllers to accommodate the position of the arms of the patient based on pre-programmed or received values for the level and the inclination of the APS upper sections and the APS lower sections; a legs position system (LPS) comprising one or more LPS sensors, LPS right section, and LPS left section, the one or more LPS sensors detect the presence of the legs of the patient, and upon detecting the presence of the legs, a level and inclination of the LPS right section and LPS left section are automatically positioned by the one or more controllers to accommodate the position of legs of the patient based on pre-programmed or received values for the level and the inclination of the LPS right section and LPS left section; and a body position system (BPS) comprising one or more BPS sensors, a BPS upper section, and a BPS lower section, the one or more BPS sensors detect the presence of the torso of the patient, and upon detecting the presence of the torso, a level and inclination of the BPS upper section and the BPS lower section are automatically positioned by the one or more controllers to accommodate the position of the torso of the patient based on pre-programmed or received values for the level and the inclination of the BPS upper section and the BPS lower section In a particular case, the reconfigurable proning bed further comprising an entertainment position system (EPS), the entertainment position system comprising one or more EPS sensors to detect a position of the face of the patient and directions of the eyes, and a plurality of actuated EPS components that are configurable and reconfigurable by the one or more controllers to be automatically positioned to accommodate the position of the face and to follow the direction of the eyes of the patient based on the detected position of the face and the direction of the eyes.

In another case, the plurality of actuated EPS components comprise one or more EPS actuators, a display connected to the one or more EPS actuators, and an EPS control unit to instruct display of visuals on the one or more displays.

In yet another case, the one or more displays comprise a touchscreen to display visuals and receive inputs.

In yet another case, the reconfigurable proning bed further comprising one or more side rail position systems (SRPS), the side rail position systems comprise a side rail on each side of the reconfigurable proning bed, one or more SRPS sensors, one or more SPRS actuators connected to each of the side rails, and one or more displays, the side rails configurable and reconfigurable by the one or more controllers to be automatically positioned to provide safe enclosure for the patient via actuation of the one or more SPRS actuators based on the one or more SRPS sensors.

In yet another case, the one or more displays comprise a touchscreen to display visuals and receive inputs.

In yet another case, the actuated pillow components of the HPS define a hole therebetween for receiving the patient's face, and where the actuated pillow components comprises one or more reconfigurable face supports.

In yet another case, the actuated pillow components of the head position system further comprise one or more pillows with a curved section to support the head and the chin of the patient, wherein the curved section accommodate the HPS sensors.

In yet another case, the one or more reconfigurable face supports comprise one or more detachable actuated pillows and one or more separating plates, the detachable actuated pillows comprise one or more magnetic plates, the actuated pillow components define one or more holes to receive the separating plates, the separating plates moveable as instructed by the one or more controllers to be positioned to accommodate the size of the face of the patient, wherein the pillows follow the movement of the separating plates due to attraction from the one or more magnetic plates based on the size.

In yet another case, the level and inclination of the BPS upper section and the BPS lower section are separately configurable and reconfigurable by the one or more controllers to reposition a respective supported body part of the patient.

In yet another case, the APS comprises upper right, lower right, upper left, and lower left arm sections, the one or more APS sensors detect the presence of each of the arms of the patient, and wherein the level and the inclination of the upper section and the lower section of each the left and right arm sections are separately configurable and reconfigurable by the one or more controllers to automatically reposition the level and inclination of the respective arms of the patient based on the detected presence using APS actuators.

In yet another case, the LPS comprises a right leg section and a left leg section, the one or more LPS sensors detect the presence of the legs of the patient, and wherein the level and the inclination of each the left leg section and the right leg section are separately configurable and reconfigurable by the one or more controllers to automatically reposition the respective legs of the patient based on the detected presence using LPS actuators.

In yet another case, the plurality of actuated BPS components are configurable and reconfigurable by the one or more controllers to be positioned to change the level and inclination of the BPS upper section and BPS lower section to accommodate the preferences of the patient based on input received.

In yet another case, the plurality of actuated APS components are configurable and reconfigurable by the one or more controllers to be positioned to change the level and inclination of the APS sections to accommodate the preferences of the patient based on input received.

In yet another case, the plurality of actuated LPS components are configurable and reconfigurable by the one or more controllers to be positioned to change the level and inclination of the LPS sections to accommodate the preferences of the patient based on input received.

In yet another case, the plurality of actuated EPS components are configurable and reconfigurable by the one or more controllers to be positioned to change the level and inclination of the display to accommodate the preferences of the patient based on input received.

In yet another case, the plurality of actuated SRPS components are configurable and reconfigurable by the one or more controllers to be positioned to change the level and inclination to accommodate the preferences of the patient based on input received.

In yet another case, the received values comprise inputs received from a caregiver.

These and other embodiments are contemplated and described herein. It will be appreciated that the foregoing summary sets out representative aspects of systems and methods to assist skilled readers in understanding the following detailed description.

BRIEF DESCRIPTION OF THE DRAWINGS

Preferred embodiments of the present disclosure will now be described, by way of example only, with reference to the attached Figures, wherein.

Figure 19:
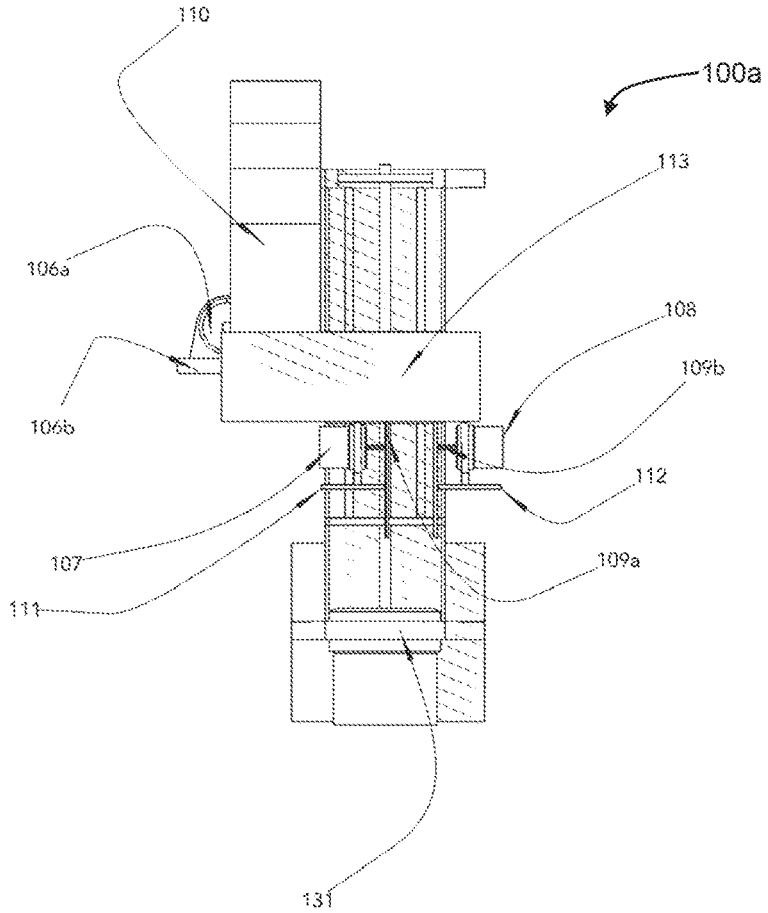
Figure 20:
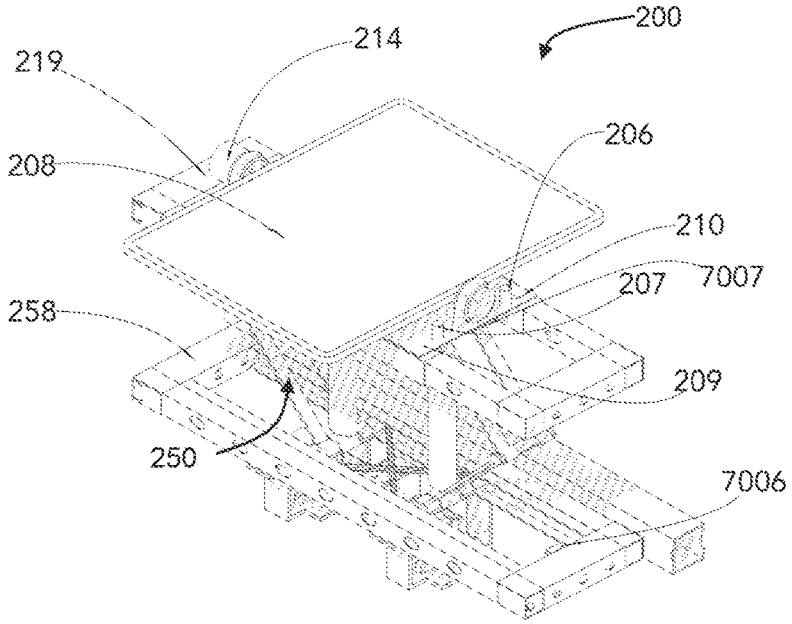
Figure 21:
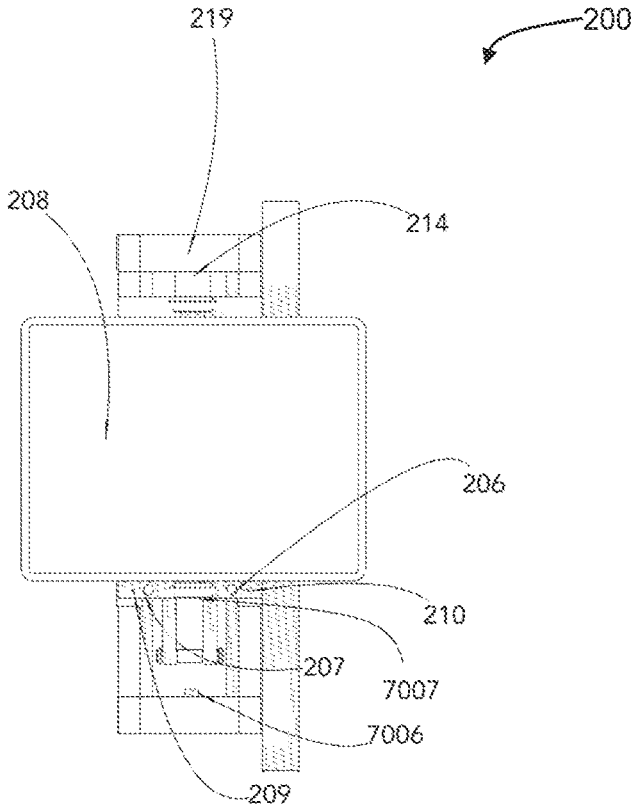
Figure 22:
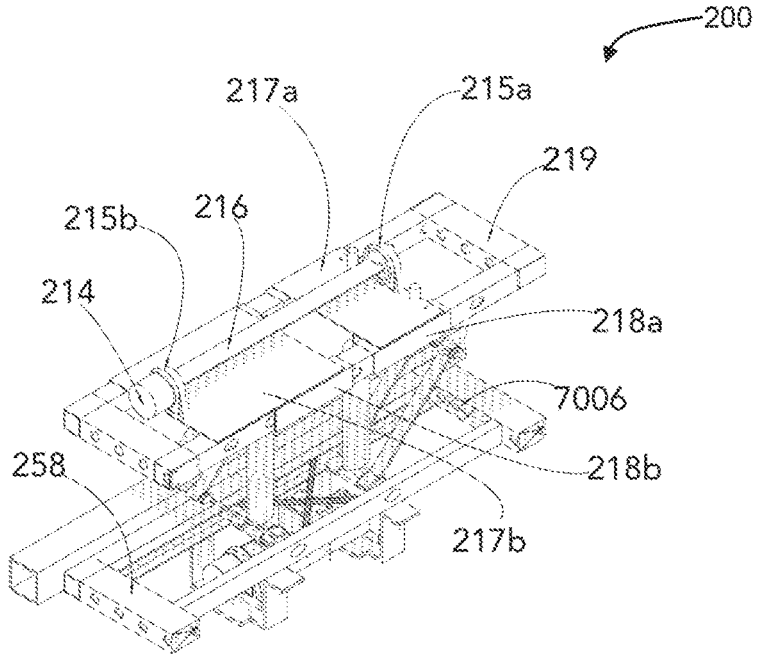
Figure 23:
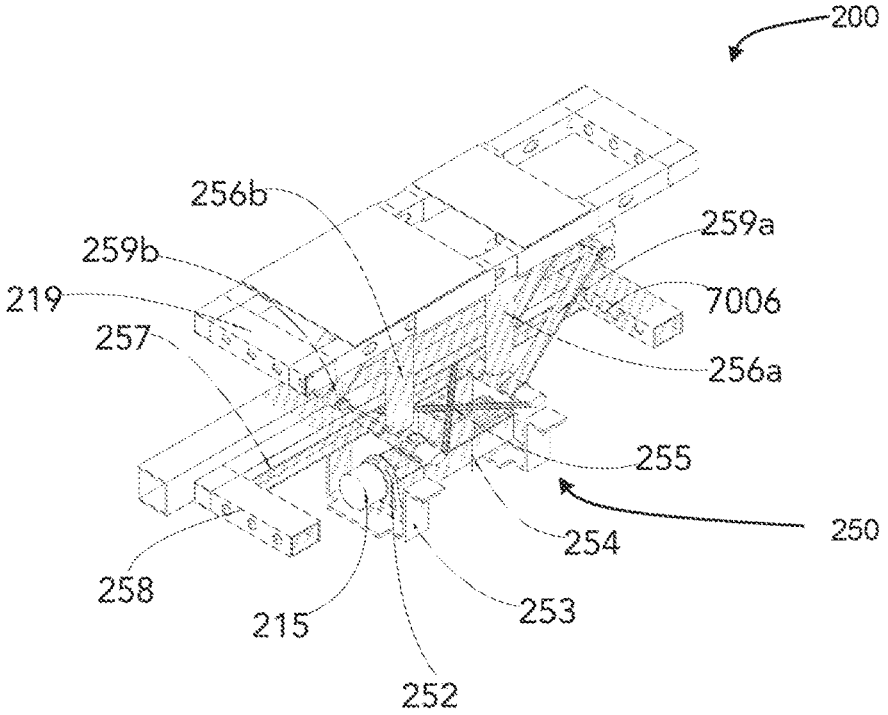
Figure 24:
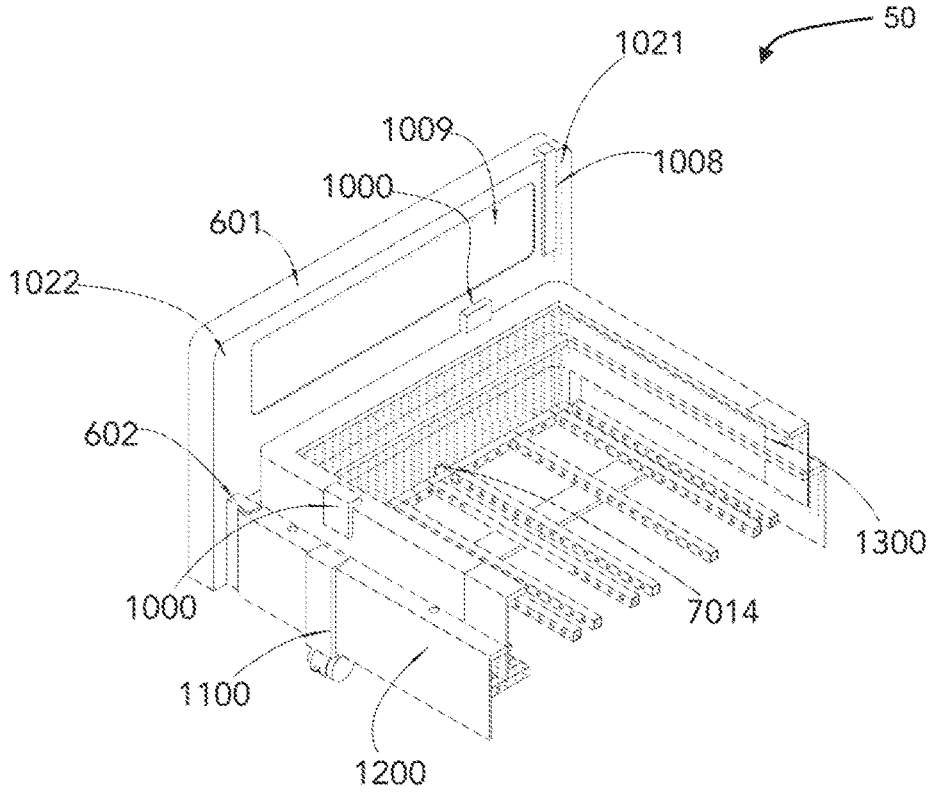
Figure 25:
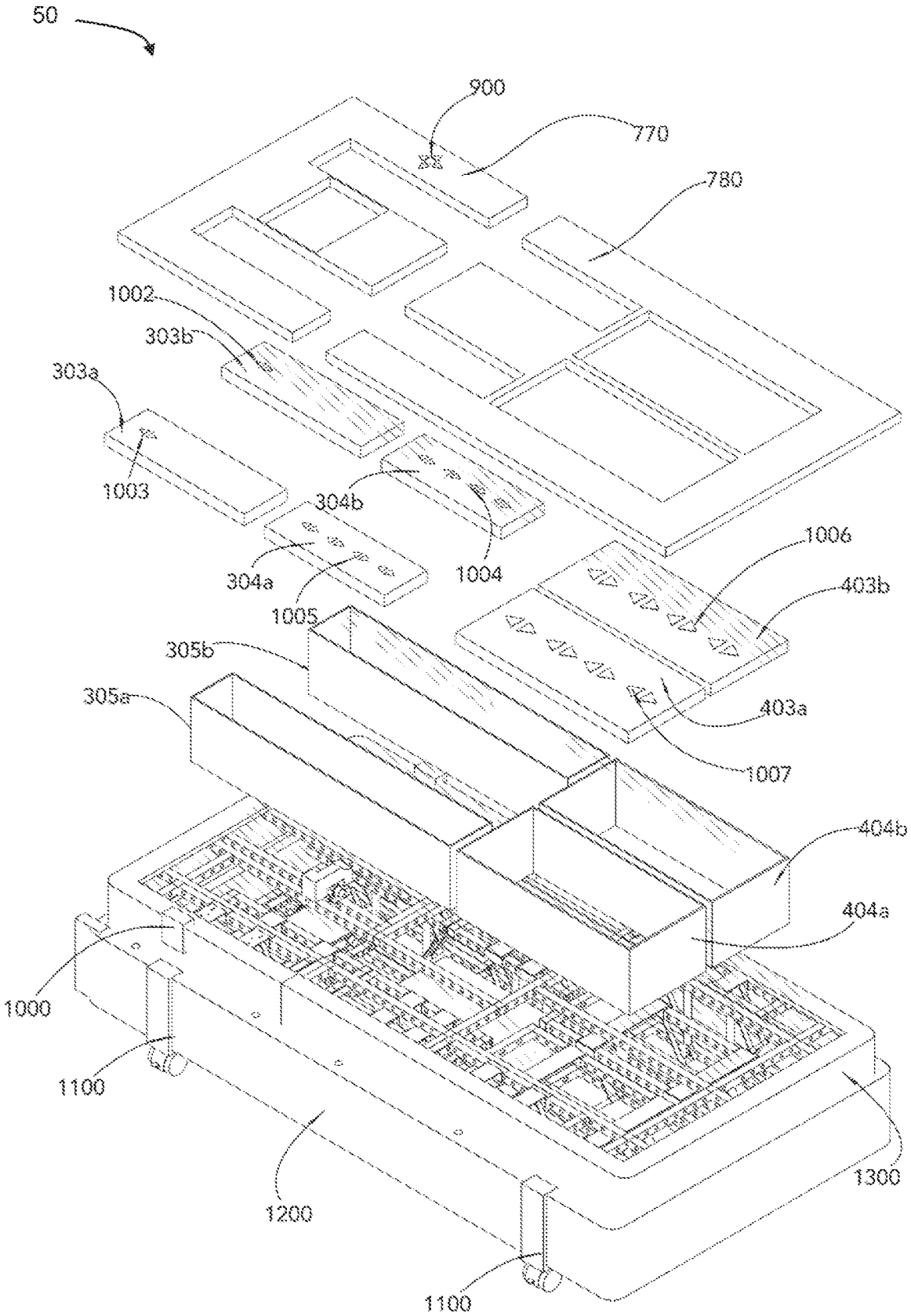
Figure 26:
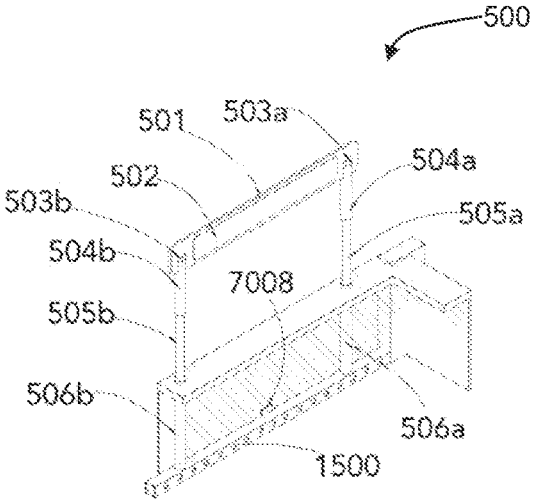
Figure 27:
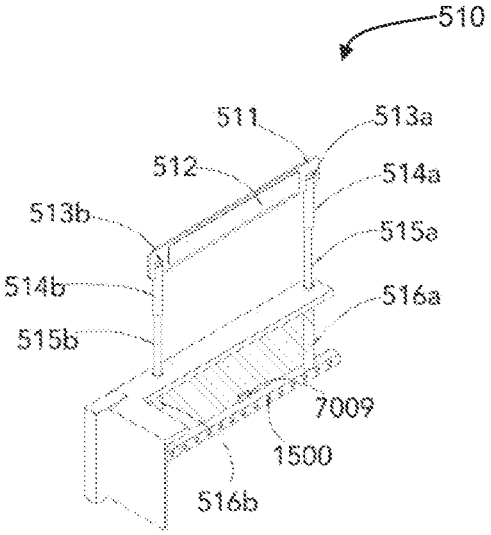
Figure 28:
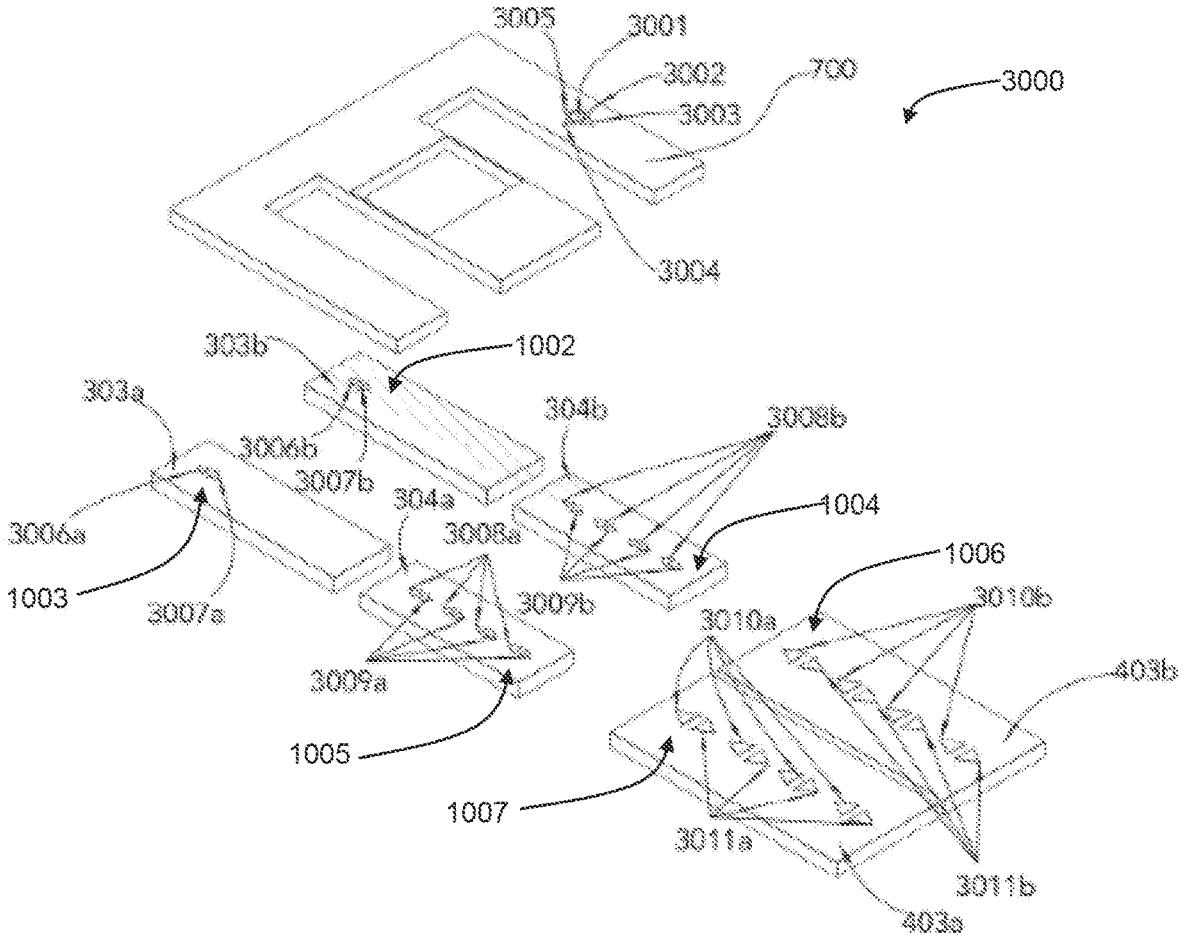
Figure 29:
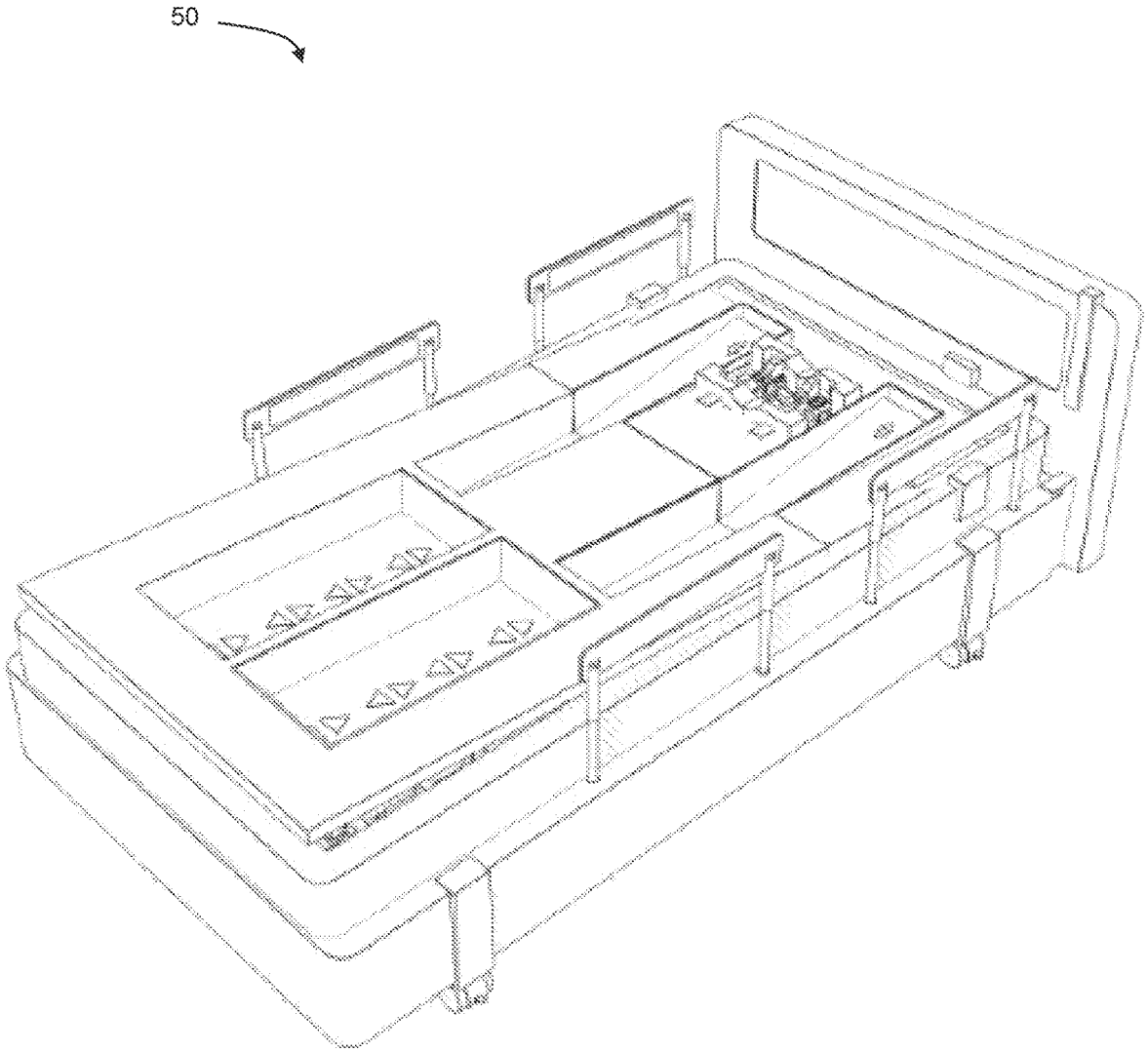
Figure 30:
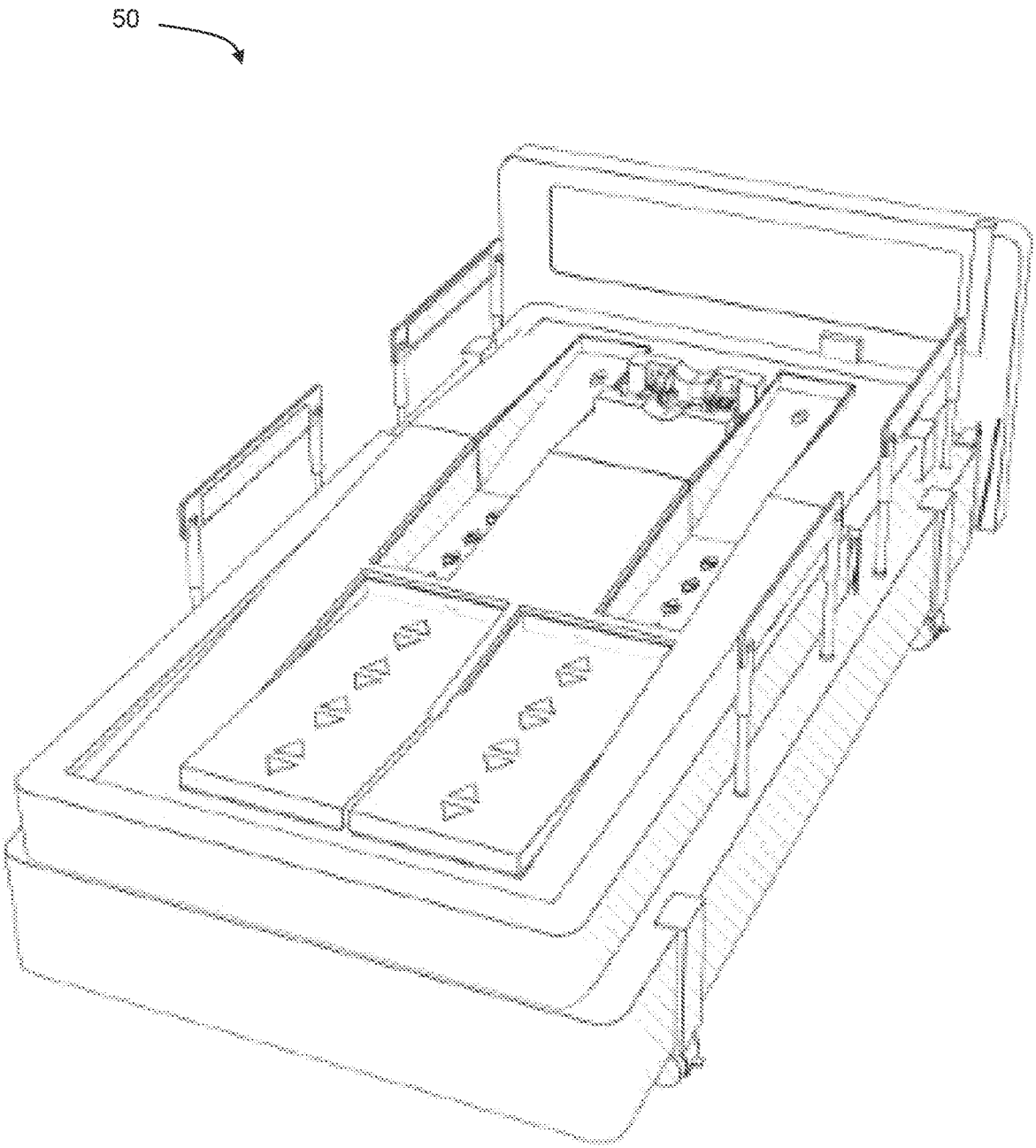
Figure 31:
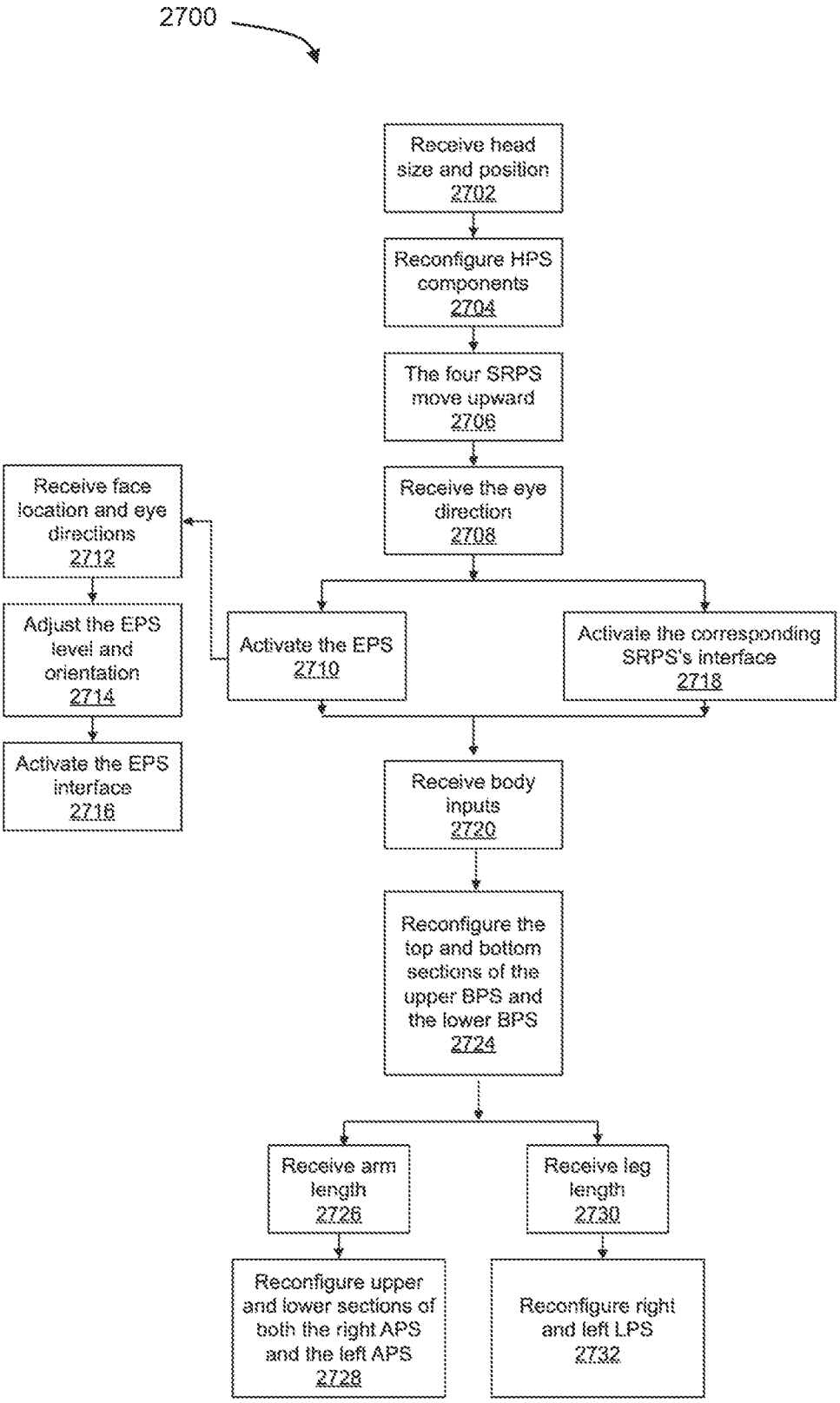

after removing the U-shaped foam piece and showing the inner architecture of the head position system of the reconfigurable proning bed;

FIG. 19 is a bottom view of the quarter section of the head position system of the reconfigurable proning bed;

FIG. 20 is an isometric view of an entertainment position system of the reconfigurable proning bed;

FIG. 21 is a top view of the entertainment position system of the reconfigurable proning bed;

FIG. 22 is an isometric view of a positioning system for a touchscreen of the entertainment position system of the reconfigurable proning bed;

FIG. 23 is an isometric view of an inner architecture of the positioning support system for the entertainment position system of the reconfigurable proning bed;

FIG. 24 is an isometric view of a back headboard of the reconfigurable proning bed;

FIG. 25 is an isometric view of the reconfigurable proning bed with an inner architecture of a configuration having a primary mattress and six other mattresses for arms and legs;

FIG. 26 is an isometric view of a left side rail position system of the reconfigurable proning bed;

FIG. 27 is an isometric view of a right side rail position system of the reconfigurable proning bed;

FIG. 28 is an isometric view illustrating sensors of the reconfigurable proning bed;

FIG. 29 is a perspective view of an embodiment of the reconfigurable proning bed;

FIG. 30 is a perspective view of a further configuration of the reconfigurable proning bed;

FIG. 31 is a flowchart for a method for reconfiguring a proning bed; and

Figure 32:
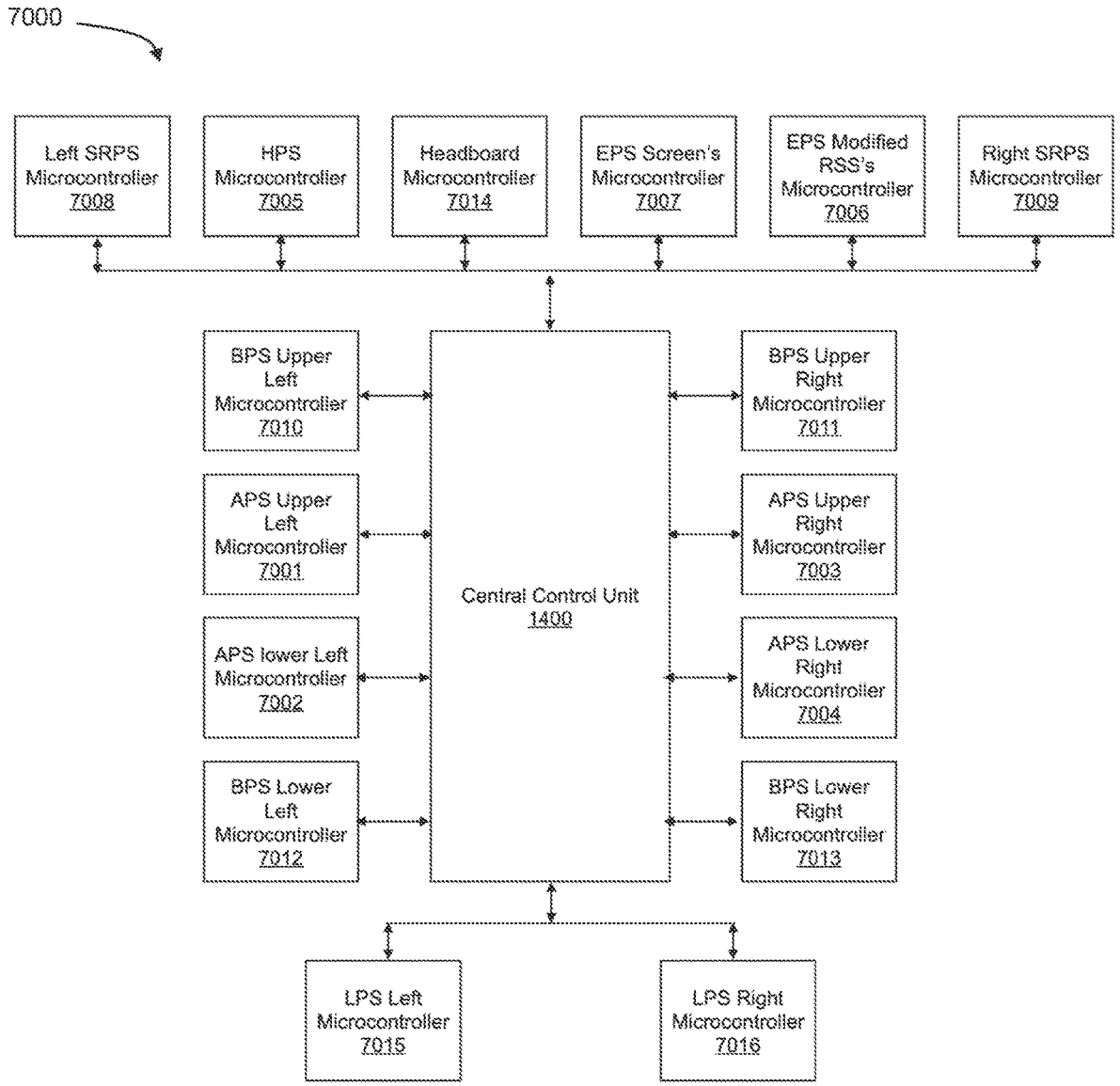

FIG. 32 is a diagram illustrating distributed and central controllers for the reconfigurable proning bed.

DETAILED DESCRIPTION

Embodiments will now be described with reference to the figures. For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it is to be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Any module, unit, component, server, computer, terminal, engine or device exemplified herein that executes instructions may include or otherwise have access to computer readable media such as storage media, computer storage media, or data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by an application, module, or both. Any such computer storage media may be part of the device or accessible or connectable thereto. Further, unless the context clearly indicates otherwise, any processor or controller set out herein may be implemented as a singular processor or as a plurality of processors. The plurality of processors may be arrayed or distributed, and any processing function referred to herein may be carried out by one or by a plurality of processors, even though a single processor may be exemplified. Any method, application or module herein described may be implemented using computer readable/executable instructions that may be stored or otherwise held by such computer readable media and executed by the one or more processors.

Any sensors exemplified herein may be used to take inputs from patients and/or caregivers and process them using one or more controlling units including microprocessors and/or computers with their CPU, RAM, ROM, flash memory or other memory technology. Sensors exemplified herein are to be used to, for example, sense and detect patients' presence, proximity, direction, orientation, measures, vision, voice, and touch are interchangeable and replaceable by other types, without compromising the spirit of the reconfigurable bed, based on embodiments of the configurable bed. For example, the configurable bed may use voice recognition as an input for reconfigurability and responding to patient's inputs and/or caregiver(s). In another example, the configurable bed may be activated using voice and/or vision and/or haptic sensors, without compromising the spirit of the reconfigurable bed disclosed herein.

Any actuators exemplified herein may be used to actuate the reconfigurable bed components which are processed using one or more controlling units including microprocessors and/or computers with their CPU, RAM, ROM, flash memory or other memory technology. Actuators exemplified herein are to be used to provide various degrees of freedom for the actuation of the configurable bed components including, for example, linear, rotational, axial, hydraulic, pneumatic, electric, and mechanical actuators which are interchangeable and replaceable by other types, without compromising the spirit of the reconfigurable bed, based on embodiments of the disclosed configurable bed. For example, the configurable bed may use light as an actuation response to reconfigurations and as an interface feedback to patient's inputs and/or caregiver(s). In another example, the configurable bed may be actuated using pneumatic actuators to provide the configuration needed by the patient/caregiver, without compromising the spirit of the reconfigurable bed disclosed herein.

The present disclosure generally relates to patient care beds; and more particularly, the present disclosure relates to a reconfigurable proning bed and a method for reconfiguring a prone bed for treatment of acute respiratory distress syndrome (ARDS).

Keeping patients in a prone position is becoming more important due to the continuing increase in the common respiratory illnesses from severe acute respiratory syndrome coronavirus 2 (SARS-CoV-2), bronchitis, asthma, occupational lung diseases, and pneumonia to pulmonary acute respiratory distress syndrome (ARDS). Beds used for proning can be generally classified into four types: regular beds, rotating beds, beds with a face hole, and inflatable mattresses. On each of these types of beds, the beds are not designed to adapt and/or reconfigure based on the physical peculiarities and personal preferences of each patient, and thus fail to alleviate the negative psychological effects of proning.

Generally, patient beds designed for proning are limited to supporting the whole body while proning; thus, they essentially lack the real-time autonomy and reconfigurability that suits patients' different needs while staying for long periods in this unusual position, i.e., prone position.

Generally, mattresses and their supporting structures are designed to support patients in prone positions and lack autonomous reconfigurability and real-time adjustments to accommodate ARDS patients' extensive and continuous needs to change position of their head, arms, legs, and torso parts. Thus, there will be extensive numbness and muscle fatigue, among other long-term discomforts. Some mattresses designed for proning can have multiple different sized and shaped head support pads, including a hole for assisting breathing and vision. However, the mattresses are generally limited to the available sizes and shapes; whereby one size of the padding is used to create a static hole for the eyes, nose, and mouth to allow air exposure. Moreover, it would not allow the patients to replace pads or adjust head location and position while in the proning position unless the caregiver/nurse helps in changing the pads; in addition to the time needed to find the right fit pad for the continuous needs of the patients to change head positions, e.g., down, right and left positions. Other proning beds allow their structure to be manually adjusted to support the body, upper body, and leg positions, however do not consider the head and face positions and sizes of the patient, i.e., one sized non-configurable hole and no arm support.

Some beds can provide a patient with a mattress that can have multiple positions, such as a mattress comprised of two parts with an air bellows unit to elevate the top or bottom parts or create levels. While the system creates adjustable inflation for pressure and comfort levels, the mattress does not create a place for the head/face when proning, which may cause the same discomfort known with adjustable beds, including but not limited to head stiffness, muscle pain, numbness, among others. Other approaches can have pillow-like body supports for the torso, head, arms, elbows, and heels with holes for airflow. However, these approaches generally do not consider different sizes of patients' heads, arms, legs, and do not allow patients to change their heads, arms, and legs positions.

While there are a number of approaches for adjustable patient beds, these approaches are generally limited in their movements for patients in the proning position; for example, not including face and arms adjustments for proning. Other approaches use rotating beds, mainly used as therapeutic beds. However, generally such rotating beds require a secure fastening system to hold the head, body, hands, and legs; thus, causing the patient to be locked in position. Locking ARDS patients in the proning position for long hours can cause, but not be limited to, numbness, muscle fatigue, among other long-term discomforts. Such approaches also do not give the patient enough freedom to move his/her head, arms, and legs and change their position. The complexity of the components of such rotatable beds and the many precautions needed to secure and ensure that caregivers secure the patients before rotating limits their practicality. The straps used and the head and body movement limitations are critical components to keep the patients in the prone position. Thus, there are significant disadvantages due to the anxieties of depending on fasteners to hold the patient in place for hours, and due to not allowing adjustment of the patients' head, arms and legs positions. Other rotating beds may allow the patients to rotate the bed in a horizontal plane, i.e., XY direction. However, such beds generally do not allow the arms or the legs to be separately adjusted and generally do not accommodate ARDS patients in prone positions.

Embodiments of the reconfigurable proning bed described herein provide a number of advantages; for example, providing prone-laying patients with reconfigurable bed components which allows better airflow to the lungs while the patients have to stay for hours in this unusual position. Such as reconfigurable supporting elements for the patients' head, arms, and legs, to help them prone comfortably and for more extended periods of time. Additionally, the reconfigurable supporting elements can save the configuration personalized for a particular patient for later use.

In an embodiment, four components of a patient bed are reconfigurable for supporting prone position: a reconfigurable position to support the patient's head, a reconfigurable position to support the patient's arms, a reconfigurable position to support the patient's legs, a reconfigurable position to support the patient's torso, and a reconfigurable position to support the patient's entertainment system.

The reconfigurable head position includes force and/or position sensors located on to detect head position. Once the sensors detect the face, the system can actuate linear actuators and reconfigure the head support to provide sufficient room for the eyes, nose, and mouth of the patient to allow for better breathing through a hole in a top portion of the bed. Additionally, a pillow having two sides can be adjusted using actuators embedded within the pillow.

The reconfigurable body, arms and legs supporting systems include force and/or position sensors to detect torso, arms and legs positions, and can be used to adjust a level and angle of inclination of the torso, arms and legs supports. Once the sensors detect the torso, arms and legs, the system can actuate actuators to position the torso, arms and legs to a level and inclination that best supports blood circulation.

The reconfigurable entertainment system can use a camera for eye detection and proximity sensors, and actuators for adjusting a position and level of an entertainment frame to reach a level, position, and inclination that best fits the head and eyes positions.

By employing sensors to direct actuators for controlling the position of the patients' head, torso, arms and legs, the reconfigurable bed is able to fully support the patient in prone position in a manner that is supporting and comfortable while proning for long periods. Advantageously, the patient bed of the present embodiments can enhance comfort by considering differences in patients' head sizes, shapes, and preferences while proning, and the need to change, i.e., reconfigure, the position of the patient's arms and legs due to this unusual body position in order to reduce numbness, muscles fatigue, among other long-term discomforts.

As described herein, embodiments of the present disclosure provide reconfigurable, and in some cases autonomous, positioning systems or devices; including one or more of a head position system (HPS), a body position system (BPS), an arms position system (APS), a legs position system (LPS), a side rails position system (SRPS), and an entertainment position system (EPS).

In some cases, the HPS comprises four cushioned pillow components, force and/or position sensors, and multiple actuators located on the top and bottom to detect and actuate the HPS. Once the sensors detect the patient's forehead, the system can automatically activate the actuators, moving the four components or parts of the pillow, and reconfiguring the HPS to provide sufficient room for the eyes, nose, and mouth to allow more air for better breathing and viewing through a hole for receiving the patient's face. Additionally, the HPS's two sides can horizontally rotate and adjust their lengths based on the distance between the top and bottom parts by using multiple actuators embedded within the pillow.

In other cases, the patient may prefer to put their face to the side, which when supported by the four sides of the pillow, i.e., face supports, can be directly activated using servo motors attached to the two sides of the pillow by providing the correct length and rotation. The four sides of the pillow can be automatically adjusted using various subcomponents of the HPS. In some cases, when the side face supports are not used, they can autonomously fold, providing room for side airflow. The present embodiments can autonomously reconfigure based on face sizes and positions based on the inputs from the force and position sensors; thus, it can continuously reconfigure to suit patients of different ages, sizes, and preferences.

Embodiments of the present disclosure can have the BPS, APS and the LPS include force and/or position sensors located on the top and bottom to detect torso, arms and legs positions and control a positioner associated with each appendage. Multiple sensors on each positioner can be used to adjust level and inclination of the torso, arms and legs. Once the sensors detect the torso, arms and legs, the system can actuate actuators to reach a level and inclination that best supports blood circulation to the torso, the feet and the hands of the patient. In some cases, the patient and/or caregiver can also manually adjust the positioners.

Embodiments of the present disclosure can have the EPS include cameras (for eye detection) and proximity sensors, and actuators for adjusting the position, level, and rotation of an entertainment frame. In some cases, a controlling interface located on or near the screen can be used to adjust the sound and control the interface. Once the sensor detects the eyes' directions and distance between the patient's head and frame, the system can actuate the actuators to reach a level, position, and inclination that best suits the current head position. In some cases, the frame can also autonomously rotate to follow the eye movements and face direction. The EPS provides a substantial advantage due to the long periods expected from ARDS patients in this unusual position by providing an entertainment platform; for example, for engaging with families, watching a movie, listening to calming music, or reading a digital book, and the like.

Embodiments of the present disclosure can have the SRPS include a side rail comprising a safety board and structure and actuators to move the side rails upward and downward. The SRPS can be linked to the HPS position such that once the HPS detects the patient's head, the SRPS can automatically actuate and move upward.

Figure 1:
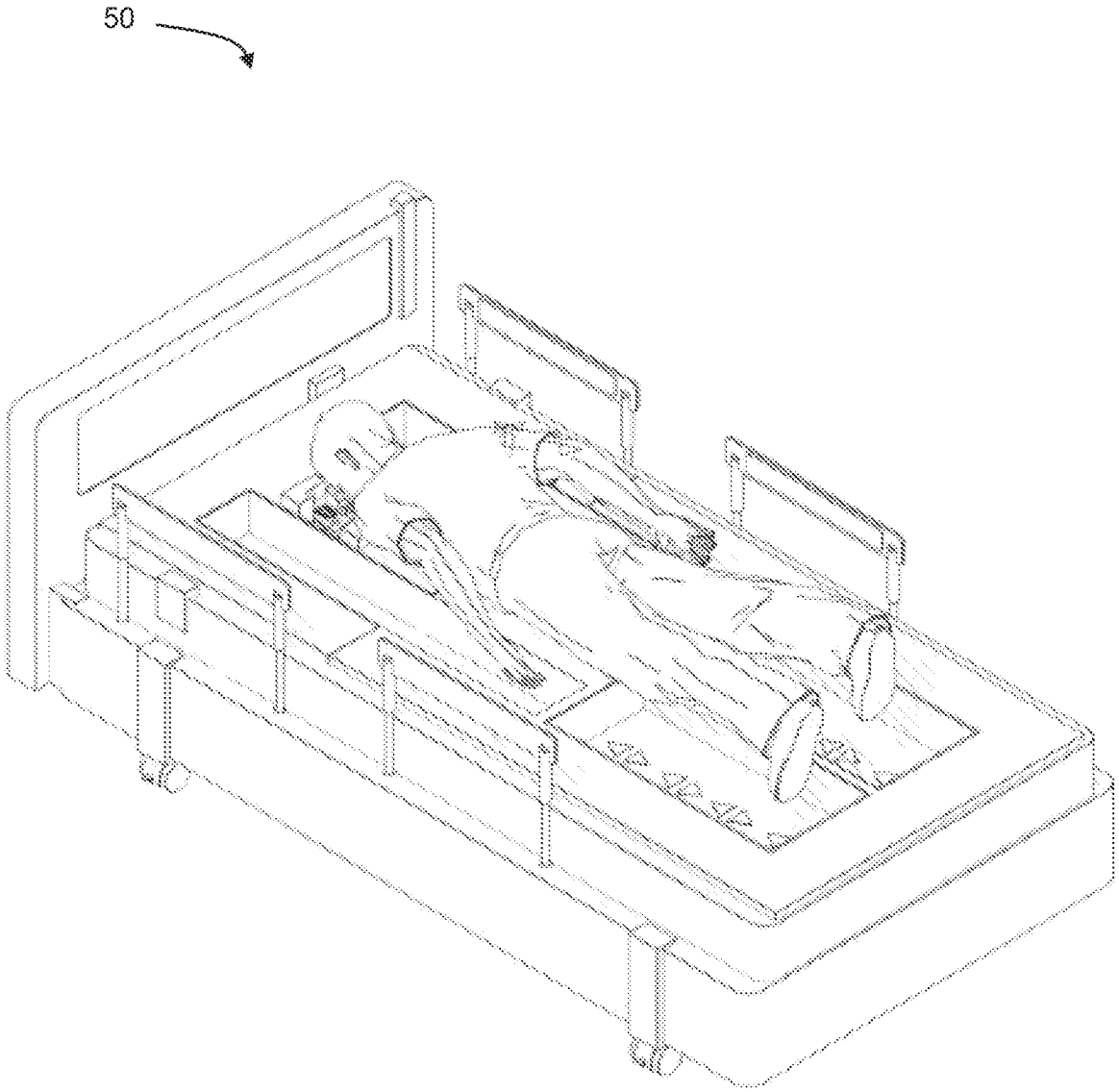
FIG. 1 is a rendered perspective view of an embodiment of a reconfigurable proning bed.

Turning to FIG. 1, a perspective view of an embodiment of a reconfigurable proning bed 50 is illustrated; showing a patient lying in the prone position on the bed 50.

Figure 2:
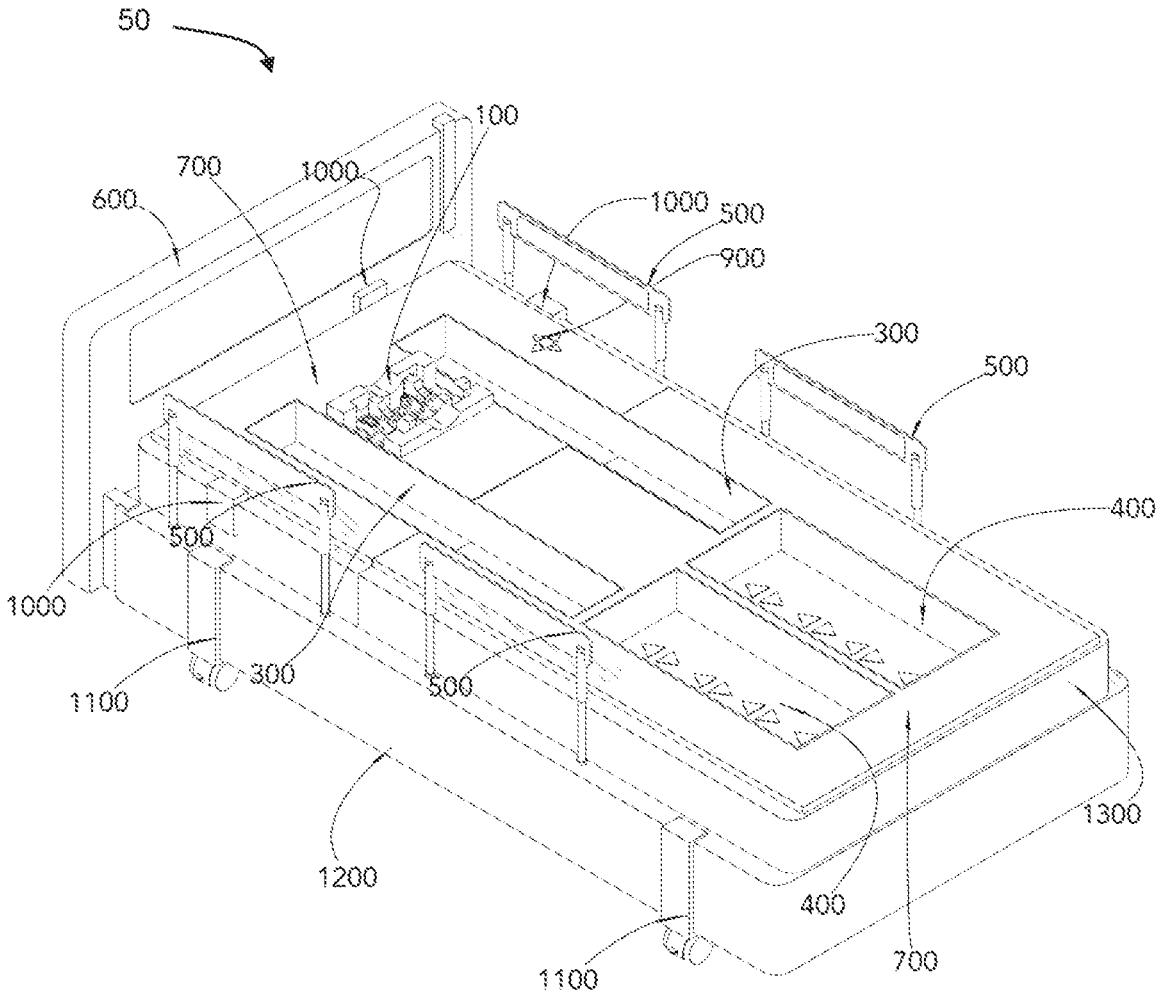
FIG. 2 is a perspective view of an embodiment of the reconfigurable proning bed.
Figure 4:
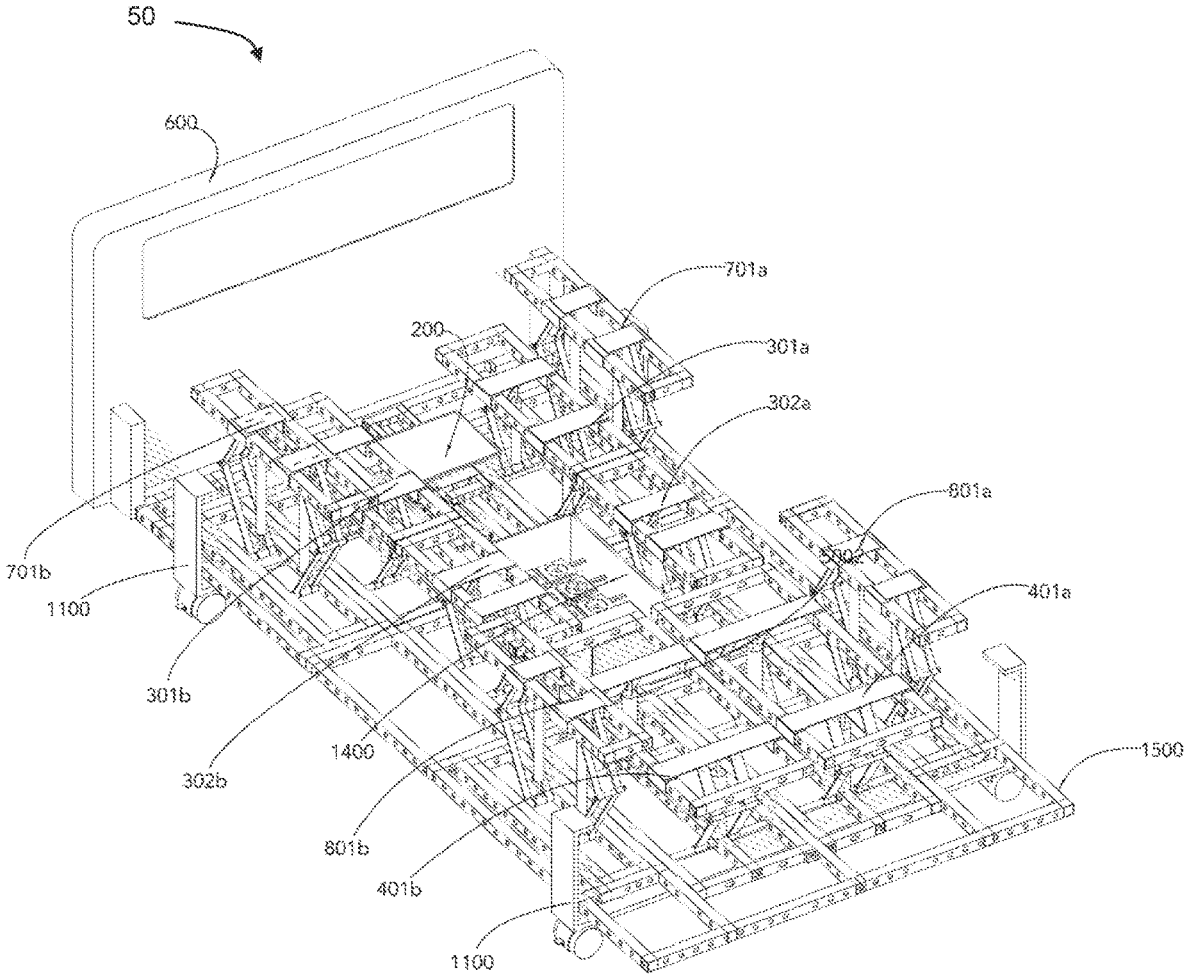
FIG. 4 is an isometric view of an inner architecture of the reconfigurable proning bed.

FIG. 2 illustrates a perspective view of the reconfigurable proning bed 50 showing various components, including showing a head position system (HPS) 100, a body position system (BPS) 700, an arms position system (APS) 300, a side rails position system (SRPS) 500, a legs position system (LPS) 400, and an entertainment position system (EPS) 200 (as further illustrated in FIG. 4).

The reconfigurable proning bed 50 includes in some cases, there can be ten reconfigurable supporting systems (RSS), four located proximate the patient's upper and lower portions of torso (e.g., the chest, and the chest to abdomen or hip) and the upper portion of the legs (e.g., hip to knee), four located proximate the patient's upper and lower portions of the arms (e.g., the shoulder to the elbow, and the elbow to the hands) and two located proximate the patient's legs (e.g., lower portion of the legs, the knee to the feet). In some cases, reconfigurable proning bed 50 can include modified RSS located to support and reconfigure an EPS system. In some cases, reconfigurable proning bed 50 can include associated mattresses 770 and 780 as part of the BPS. The mattresses can include five holes: one hole for the head, two holes for the arms on the upper section, and two holes for the legs on the lower section. The reconfigurable proning bed 50 can move by two transverse structural beams 1100 each located on two wheels. In some cases, the wheels can be electromechanical such that they can be configured to be locked upon receiving an appropriate signal.

In some cases, the reconfigurable proning bed 50 can include the head position system (HPS) fixed to the upper section of the bed position system (BPS) to advantageously avoid unnecessary stress to the patient's neck by having different levels and inclinations. Accordingly, configuration and reconfiguration of the level and/or inclination of the head of the patient supported by the HPS can be based on the level and/or inclination of the upper portion of the torso (e.g., the chest) supported by the BPS upper section. For example, the default position of the BPS sections is at 24 inches height and no inclination; thus, the HPS is at the same height and inclination of the upper BPS. In an example, for a pre-configuration set by the caregiver, the upper BPS section is reconfigured using the two RSS systems, 701*a* and 701*b*, to a height of 28 inches and inclined toward the headboard at an angle of 15 degrees; thus, the HPS will be reconfigured to the same level and inclination of the upper BPS section.

Figure 7:
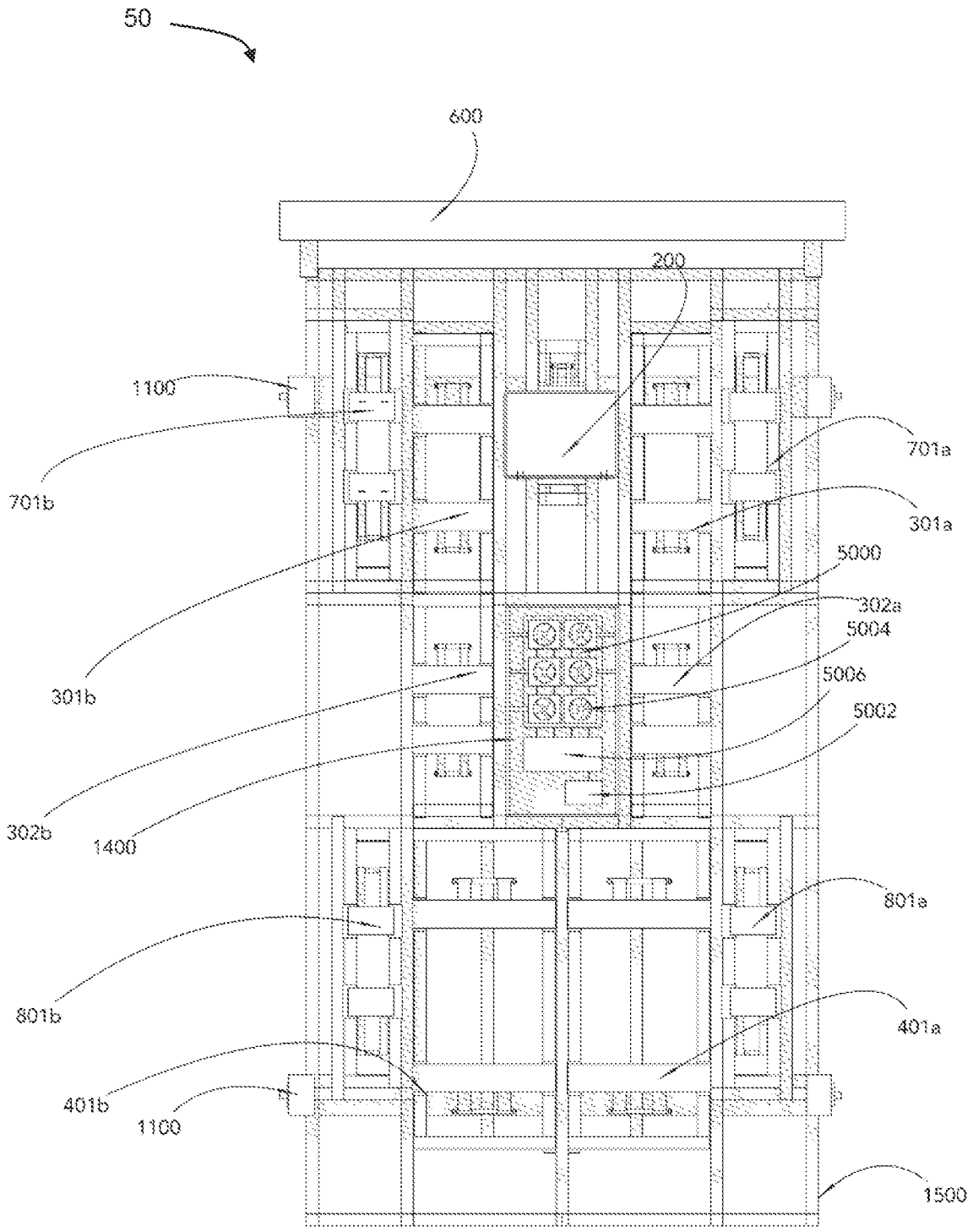
FIG. 7 is a top view of the inner architecture of the reconfigurable proning bed.

The reconfigurable proning bed 50 can include one or more user interfaces 1000 in communication with a control system 1400 (illustrated in FIG. 7). The central controller 1400 comprises one or more processors 5000 (with one or more cooling fans 5004 and central computing resources 5006) in communication with a data storage 5002, to execute the functions described herein either directly or via a suitable operating system. In some cases, each of the systems (the head position system, the body position system, the arms position system, the legs position system, the side rails position system and the entertainment position system) can include local microcontrollers that communicate with the central controller 1400 using wired connection via the bottom frame 1500 or wireless connection (e.g., Bluetooth™). In a particular embodiment, there can be three user interfaces 1000, one located on either side of the bed 50 near a top portion, and a third located at the top of the bed 50. In some cases, the user interfaces 1000 can comprise one or more touchscreens for receiving user input (1009, 502, 512, 208). In a particular case, two supplemental touchscreens 502 and 512 are located on a top portion of the SRPS 500, a primary touchscreen 1009, mainly used by caregivers, located on the back of a headboard 600, and a fourth screen 208 located directly below the HPS 100.

Figure 3:
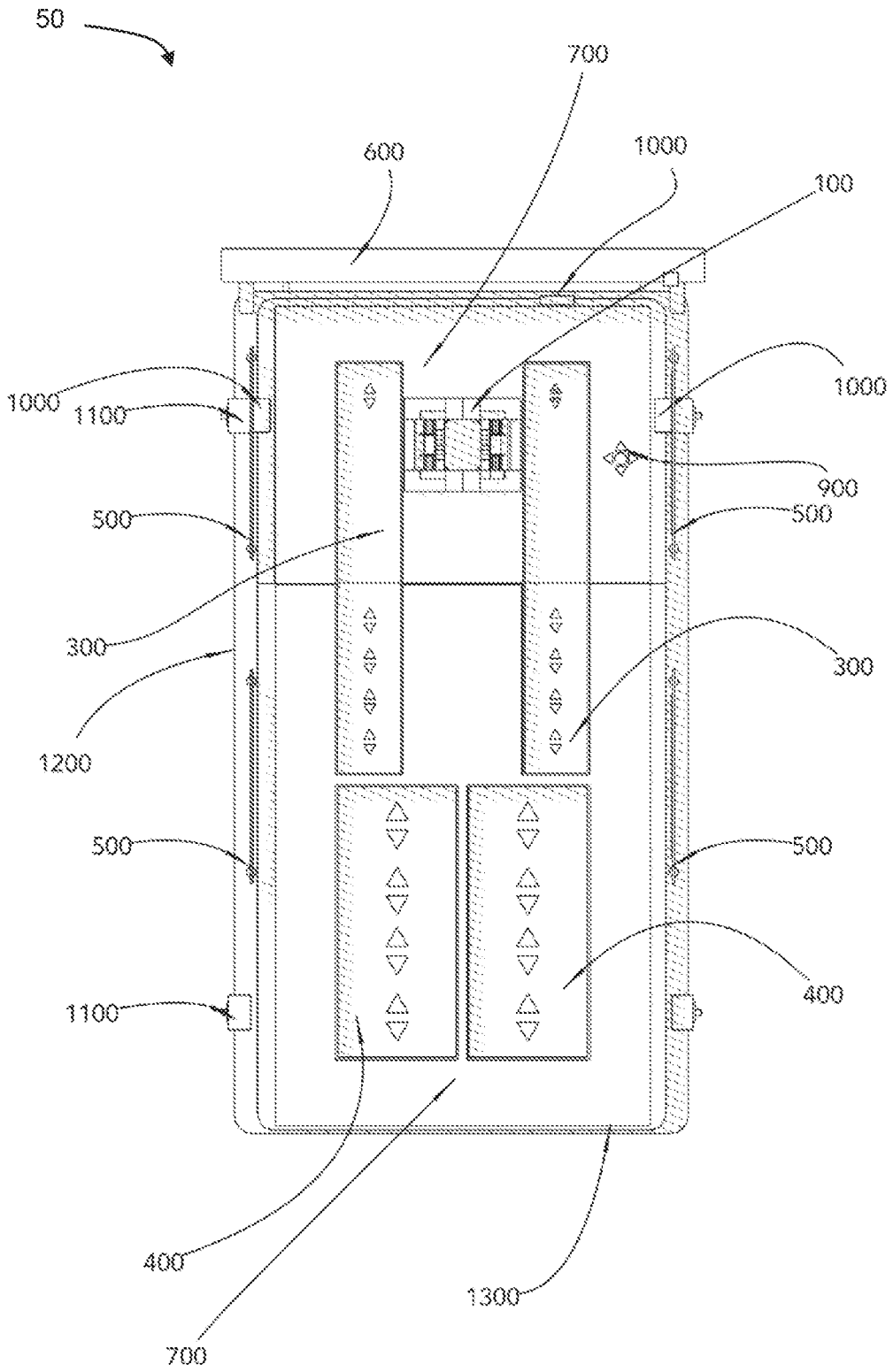
FIG. 3 is a top view of the reconfigurable proning bed.

FIG. 3 is a top view of the reconfigurable proning bed 50. Illustrated is the BPS 700, APS 300, and LPS 400 positioning systems. Also illustrated is the HPS 100 system and four SRPS 500. The BPS 700, APS 300 and LPS 400 positioning systems are activated by force and/or position sensors located on or associated with each positioner to detect arms and legs positions.

FIG. 4 is an isometric view of an inner architecture of the reconfigurable proning bed 50. Illustrated are ten reconfigurable supporting systems (RSS) 701*a*, 701*b*, 801*a*, 801*b*, 301*a*, 301*b*, 302*a*, 302*b*, 401*a*, and 401*b*; the EPS 200; a back headboard 600; two transverse structural beams 1100; a central control system 1400; and a lower frame 1500.

Figure 5:
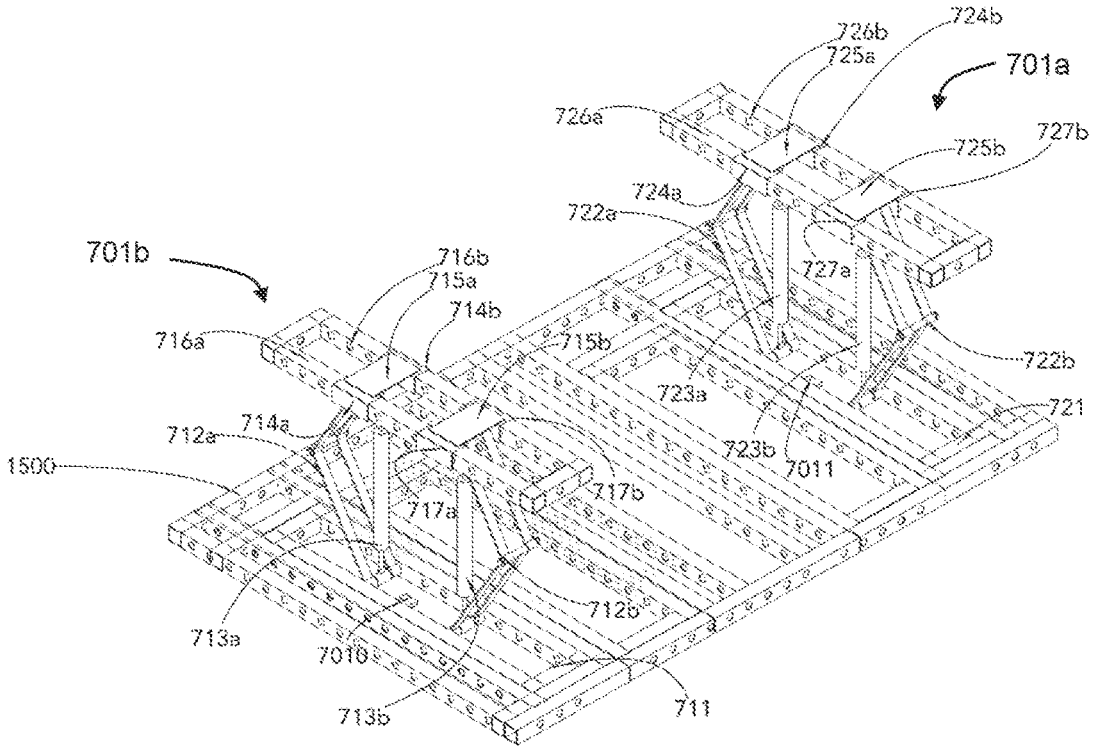
FIG. 5 is an isometric view of one of the reconfigurable supporting systems of the upper or lower portions of the body positioning system of the reconfigurable proning bed.
Figure 6:
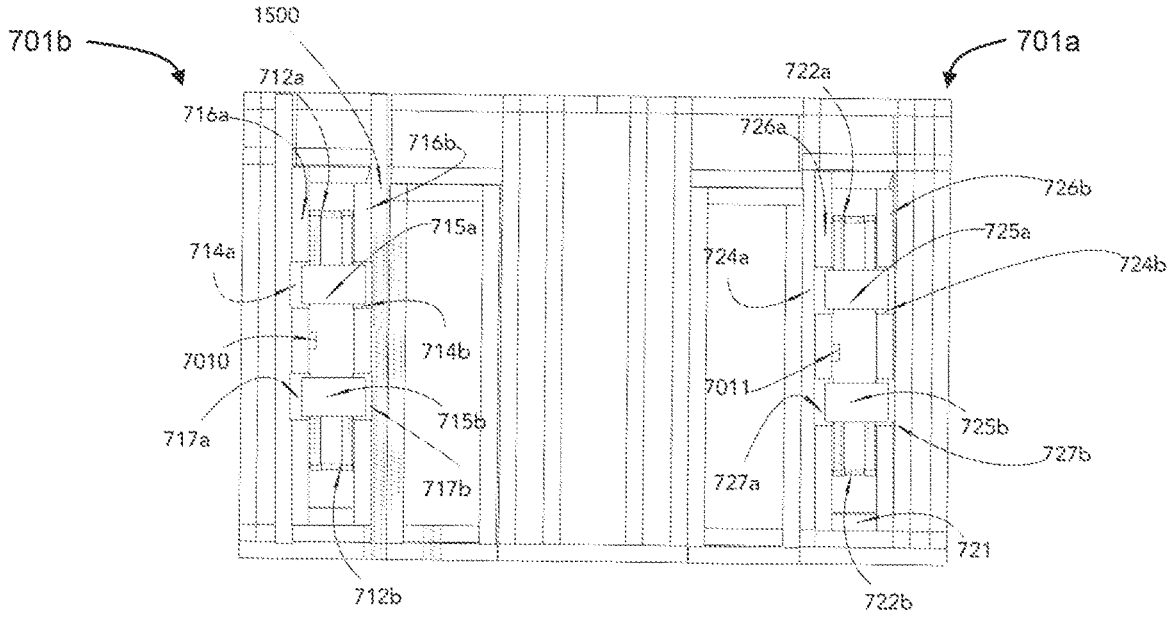
FIG. 6 is a top view of one of the reconfigurable supporting systems of the upper or lower portions of the body positioning system of the reconfigurable proning bed.

FIG. 5 is an isometric view, and FIG. 6 is a top view, of the reconfigurable supporting system (RSS) 701 of the upper body position system (BPS) 700 is used to mechanically adjust the level and/or inclination of the upper mattress 770 (as illustrated in FIG. 25,) and the same supporting system (RSS) 801 of the lower body position system (BPS) 700 is used to mechanically adjust the level and/or inclination of the lower mattress 780 (as illustrated in FIG. 25) of the reconfigurable proning bed 50. In an embodiment, the RSS includes an upper RSS comprising left 701*b* and right 701*a*, and a lower RSS comprising left 801*b* and right 801*a*. Each are used to mechanically adjust the level and to configure an upper and lower level and/or inclinations of the upper and lower BPS. The RSS of the BPS are activated by sensors (e.g., touch, force, pushbutton, and/or position sensors), for example on the top right side of the BPS 700. The RSS of the BPS can be controlled, for example, by local microcontroller 7010 for upper left RSS 701*b*, local microcontroller 7012 for lower left RSS 801*b*, local microcontroller 7011 for upper right RSS 701*a*, and local microcontroller 7013 for lower right RSS 801*a*. These local microcontrollers 7010, 7011, 7012 and 7013 can be in communication to the central controller 1400 via wired or wireless connection. In some cases during activation, an upper left RSS component 701*b* and upper right RSS component 701*a*, and actuators 713*a*, 713*b*, 723*a* and 723*b* are actuated. These actuators 713*a*, 713*b*, 723*a* and 723*b* connect to a respective one of the local microcontrollers 7010 and 7011. The RSS of the BPS described herein can be configured upward, or downward, and/or inclined based on: (a) the patient's/caregiver's inputs using sensors, at a rate of, for example, 1" per click or touch; and/or, (b) autonomously, based on a pre-configuration (for example, based on previously received input from a caregiver forming a pre-programming) by employing the use of the APS, LPS and/or BPS sensors which detect the arms', the legs' and/or the torso's presence and by pre-configuring the level and inclination of the BPS via the user interface.

The RSS 701 can be activated by force and/or position sensors on the top side of the upper section of the BPS 700. Activating the RSS 701*b* and RSS 701*a* can involve actuating the linear/hydraulic actuators 713*a*, 713*b*, 723*a* and 723*b*, which communicate with the microcontroller 7010 and 7011, which is in communication with the central controller 1400 (illustrated in FIG. 7) using wired connection via the bottom frame 1500 or wireless connection (e.g., Bluetooth™). In this embodiment, the RSS 701*b* consists of upper structure 716 and lower structures 711, two closed-loop linkages 712 supporting two sliding tubes, and two metal plates 715 welded on the top of the sliding tubes. The two sliding tubes comprise a first end 714*a* and a second end 714*b* for the first sliding tube, and a first end 717*a* and a second end 717*b* for the second sliding tube. Both sliding tubes slide on the upper structure 716 back and forth based on directed movements.

In an embodiment, the RSS 701 receives the patient's/caregiver's inputs from the sensor 3001 (e.g., touch, force, pushbutton, and/or position sensors) to start activating the upper section of the BPS 700, which activate other such sensors 3002, 3003, 3004, and/or 3005, as illustrated in FIG. 25, so as to configure the level and inclination of the BPS 700. In most cases, the RSS system 701 receives the inputs via the central controller 1400. The linear or hydraulic actuators 713*a*, 713*b*, 723*a* and 723*b* actuate based on patient's inputs and preferences for the level and/or inclination. Once the central control system receives the input from the sensors, the actuators 713*a*, 713*b*, 723*a* and 723*b* move at a rate of, for example, 1" up and/or down per click/touch of the sensors, to move the plates 715*a*, 715*b*, 725*a* and 725*b* upward and/or downward. The two plates 715*a* and 715*b* are attached to the sliding tubes 714*a*, 714*b*, 717*a*, and 717*b*, and the two plates 725*a* and 725*b* are attached to the sliding tubes 724*a*, 724*b*, 727*a* and 727*b* which slide forward and/or backward on the two structural tubes 716*a* and 716*b*. Attached to the plates 715*a* and 715*b* are two closed loop linkages 712*a* and 712*b* which are actuated by the two linear or hydraulic actuators 713*a* and/or 713*b*, and attached to the plates 725*a* and 725*b* are two closed loop linkages 722*a* and 722*b* which are actuated by the linear or hydraulic actuators 713*a* and/or 713*b*, and/or 723*a* and/or 723*b*, respectively. As the actuators move upward and/or downward, the linkages will accordingly extend or reduce the distance between the upper two structural tubes 716*a* and 716*b* and a lower 711 structure of the left RSS system 701*a*, and the upper two structural tubes 726*a* and 726*b* and a lower 721 structure of the right RSS system 701*a*. Thus, the upper BPS 700 will be configured upward or downward and/or inclined based on: (a) the patient's/caregiver's inputs using the touch, force, or pushbutton sensors, at the rate described herein; and/or, (b) autonomously, based on a pre-configuration (for example, as pre-programmed by a caregiver) by employing the use of the position sensors which detect the torso position and by pre-configuring the level and inclination of the BPS upper section and BPS lower section via the user interface.

While FIG. 5 illustrates the case where the BPS level is flat, other possible and suitable inclinations can be used depending on the patient's inputs, received via the user interface, and/or activated by the force and/or position sensors located on the top positioner to detect torso position, as described herein. In an example, the BPS upper section can support the upper portion of the torso (e.g., chest) of the patient, and the BPS lower section can support the lower portion of the torso (e.g., chest to abdomen or hip) and the upper portion of the legs (e.g., hip to knee) of the patient to create a middle support for the torso of the patient while proning. In other examples, the BPS upper section, may support ranges of the torso: the chest, or the chest to the abdomen or the hip of the patient. The BPS lower section, for example, may support ranges of the torso and the upper portion of the legs (hip to knee); such ranges can include: the lower portion of the torso (e.g., abdomen to hip) and upper portion of the legs (e.g., hip to knee) or upper portion of the legs (e.g., hip to knee) of the legs of the patient while proning.

FIG. 7 is a top view of the inner architecture (also illustrated in FIG. 4) of the reconfigurable proning bed 50.

Figure 8:
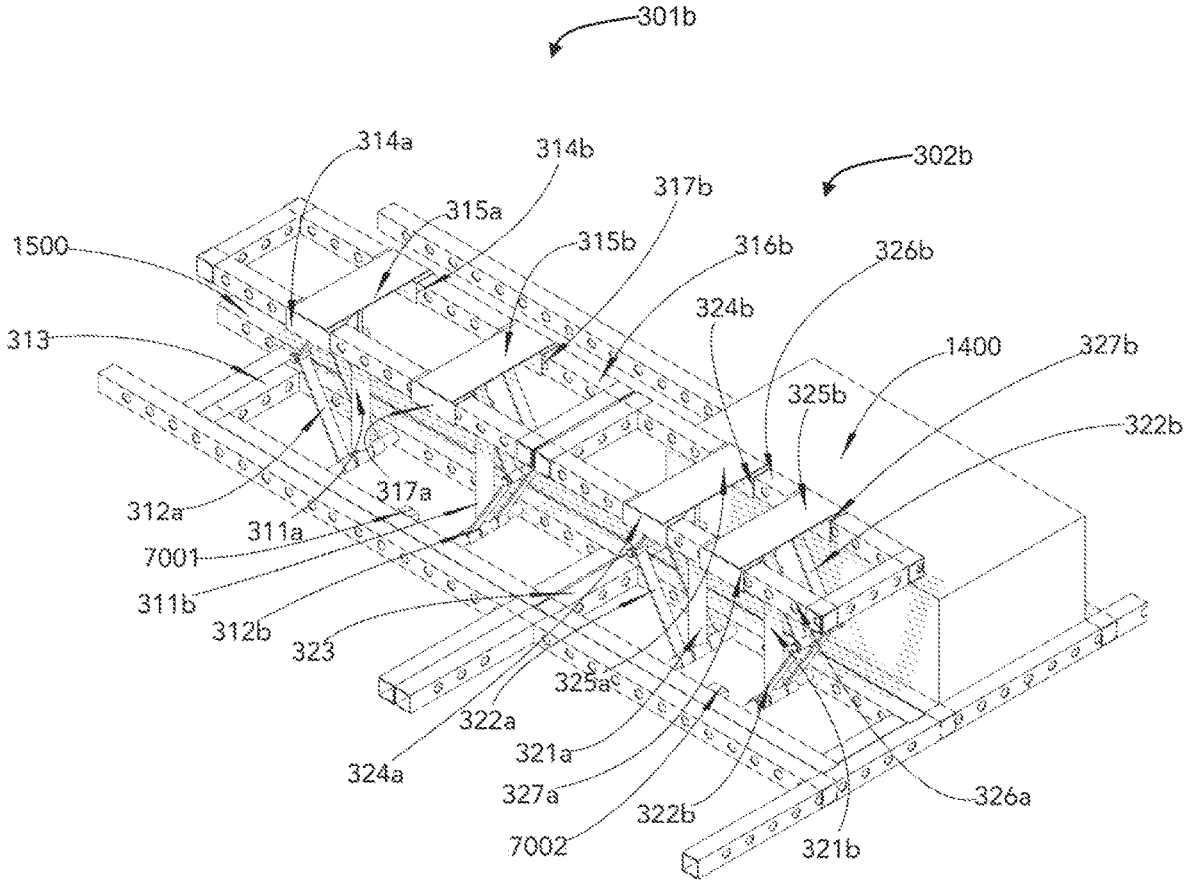
FIG. 8 is an isometric view of two reconfigurable supporting systems of the right or left arm support of the reconfigurable proning bed.
Figure 9:
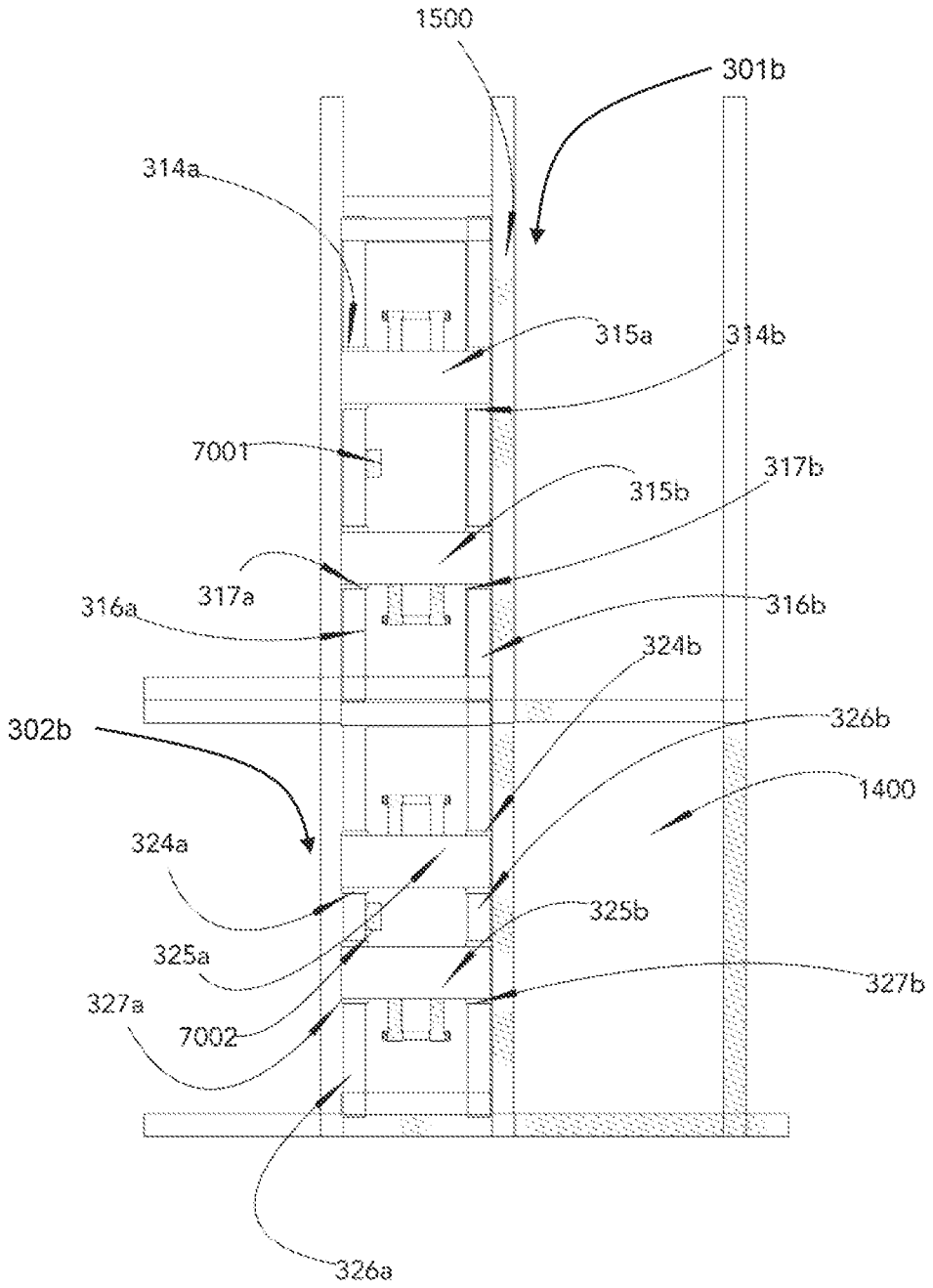
FIG. 9 is a top view of the two reconfigurable supporting systems of the right or left arm support of the of the reconfigurable proning bed.

FIG. 8 is an isometric view, and FIG. 9 is a top view, of the reconfigurable supporting system (RSS) for the left side 301*b* and 302*b* of the arms position system (APS) 300. In an embodiment, the RSS is comprising an upper RSS 301 (for example, left 301*b* and right 301*a*) and a lower RSS 302 (for example, left 302*b* and right 302*a*,) each used to mechanically adjust the level and to configure an upper and lower level and/or inclinations of the left and right APS. Similarly, the upper 301 RSS or lower 302 RSS are used for mechanically adjusting the level and inclination of the left and right legs position system (LPS) 400, illustrated as 401*a* and 401*b* as in FIG. 4. The APS's and LPS's RSS are activated by sensors (e.g., touch, force, pushbutton, and/or position sensors) on a top side of the APS 300 and LPS 400, respectively, and controlled, for example, by local microcontrollers 7001 for upper left RSS 301*b*, 7002 for lower left RSS 302*b*, 7003 for upper right RSS 301*a*, 7004 for lower left RSS 302*a*. These local microcontrollers 7001, 7002, 7003 and 7004 can be in communication to the central controller 1400 via wired or wireless connection. In some cases during activation, an upper left RSS component 301*b*, a lower left RSS component 302*b*, and actuators 311*a*, 311*b*, 321*a* and 321*b*, respectively, are actuated. These actuators 311*a*, 311*b*, 321*a* and 321*b* connect to a respective one of the local microcontrollers 7001 and 7002. The RSS system described herein can be configured upward, or downward, and/or inclined based on: (a) the patient's/caregiver's inputs using the touch, force, or pushbutton sensors, at a rate of, for example, 1" per click or touch; and/or, (b) autonomously, based on a pre-configuration (for example, based on previously received input from a caregiver forming a pre-programming) by employing the use of the APS and LPS sensors which detect the arms' and/or the legs' presence and by pre-configuring the level and inclination of the APS and LPS via the user interface.

In an embodiment, the upper left RSS component 301*b* includes lower support structures 313 attached to the main reconfigurable proning bed's 50 frame 1500, and two closed-loop linkages 312*a* and 312*b*. The two linkages support four sliding tubes 314*a*, 314*b*, 317*a*, and 317*b* attached to the top structure 316*a* and 316*b*. As the RSS system receives an input from the sensors 3006*a*, 3007*a*, 3008*a* and 3009*a*, the local microcontroller 7001 communicates with the central control system 1400 to activate the two hydraulic/linear actuators 311*a* and 311*b*, moving the two closed-loop linkages 312*a* and 312*b* upward and/or downward at a rate of, for example, 1" per click or touch. The upper structure will move upward or downward and/or incline in accordance with the sensors. The two plates 315*a* and 315*b* slide back and/or forth, causing the four tubes 314*a*, 314*b*, 317*a*, and 317*b* to slide back and forth on the upper structure 316*a* and 316*b* based on directed movements. The two metal plates 315*a* and 315*b* are welded on the top of the four tubes, which are used as a supporting base for the APS's mattresses. Accordingly, the patient/caregiver will be able to reconfigure the level and/or inclination of the upper and lower parts of the left and right arms.

Figure 10:
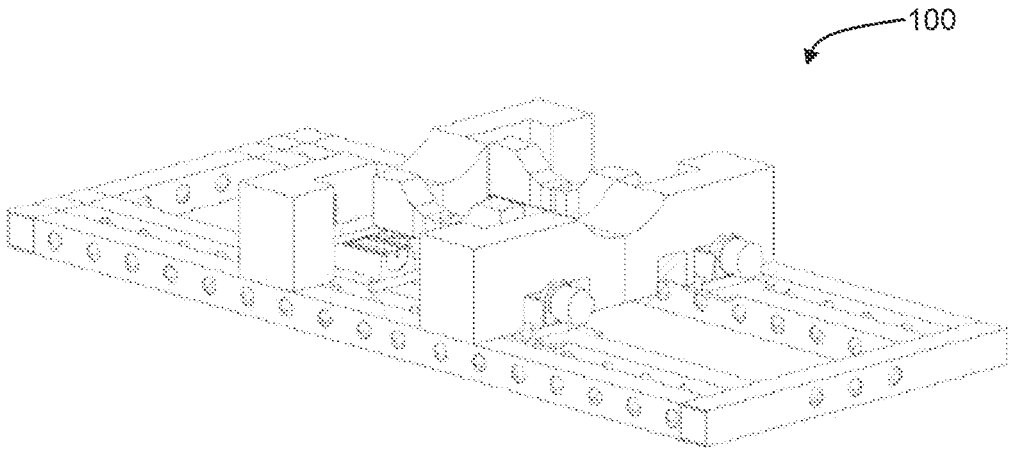
FIG. 10 is a rendered isometric view of a head position system of the reconfigurable proning bed.
Figure 11:
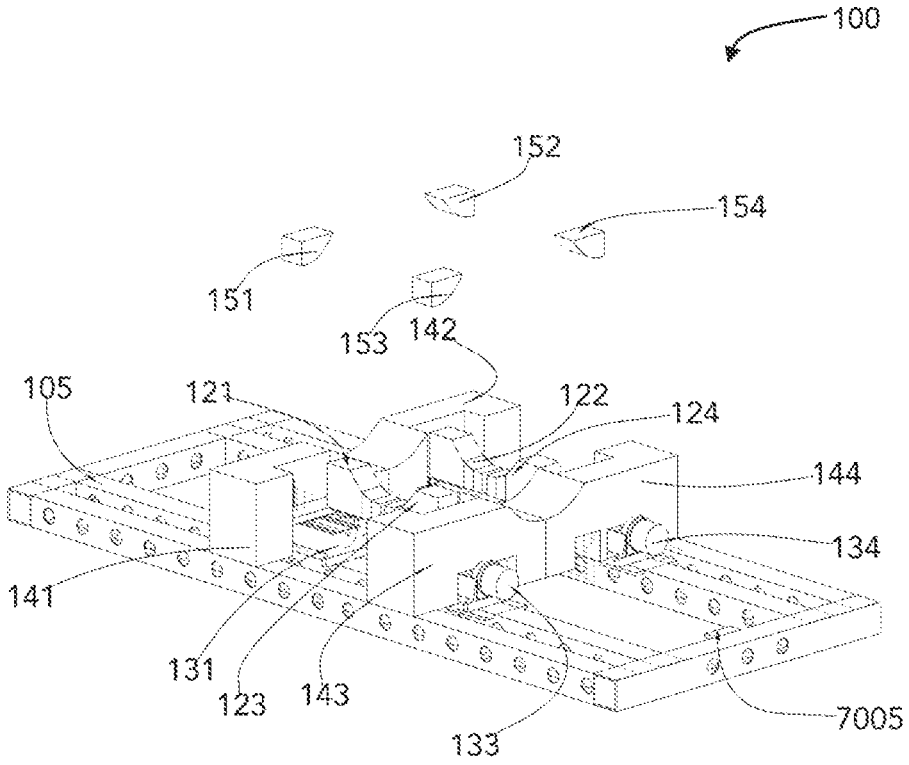
FIG. 11 is an isometric view of the head position system of the reconfigurable proning bed.
Figure 12:
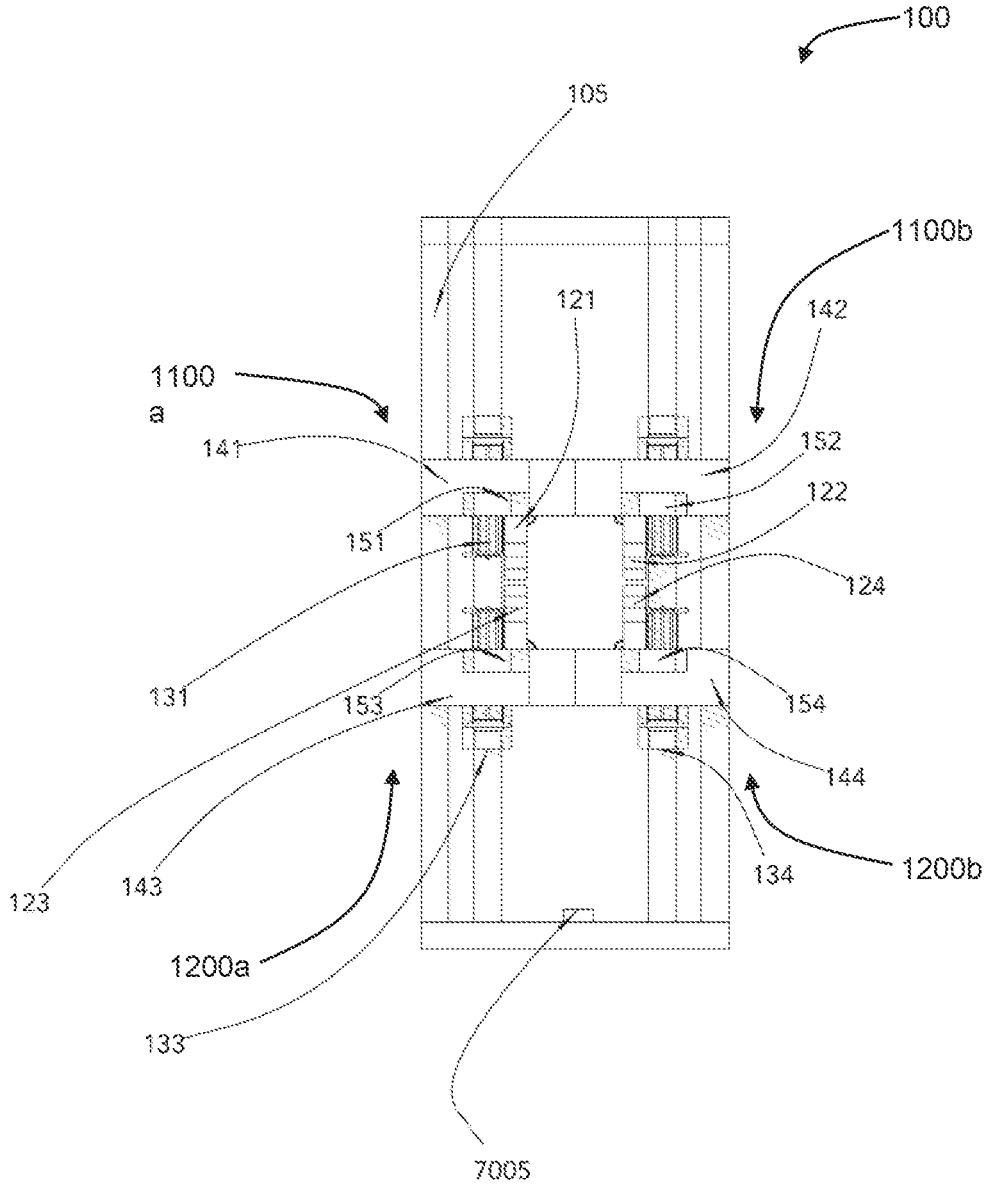
FIG. 12 is a top view of the head position system of the reconfigurable proning bed.

FIG. 10 is a rendered isometric view, FIG. 11 is an isometric view, and FIG. 12 is a top view, of the head position system (HPS) 100. In an embodiment, the HPS 100 includes four L-shaped foam pillows 141, 142, 143 and 144 with their four curved sections, to support the forehead and the chin. The HPS 100 also includes sensors (e.g., touch, force, and/or position sensors) as part of both the curved sections of the four L-shaped foam pillows and at each one of four face supports (FS) 121, 122, 123 and 124. The four I-shaped face supports (FS) 121, 122, 123 and 124 are located near the middle hole of the upper bed section 700 and actuated to rotate 90 degrees by four servo motors 106*a*. The HPS 100 also includes four linear motors 131, 132, 133 and 134 located under each L-Shaped pillow 141, 142, 143 and 144, respectively, which actuates by moving forward or backward to provide an appropriate reconfigurable size of the hole. The HPS 100 also includes four curved foam cushions 151, 152, 153 and 154 that can be used to fill the top part of the FS. The HPS 100 also includes a microcontroller 7005 connected to the central controller 1400 to process the inputs received from all HPS sensors and FS sensors, and accordingly activate the HPS's and the FS's actuators. The hole size is crucial in facilitating the airflow and in allowing the patient to enjoy the openness and to be able to be entertained while proning. The FS 121, 122, 123 and 124 can be reconfigured autonomously to allow more or less space for the different face sizes, following the actuation of the HPS 100, and based on the distance received from the linear actuators 131, 132, 133 and 134 of the HPS 100, as described herein.

Figure 13:
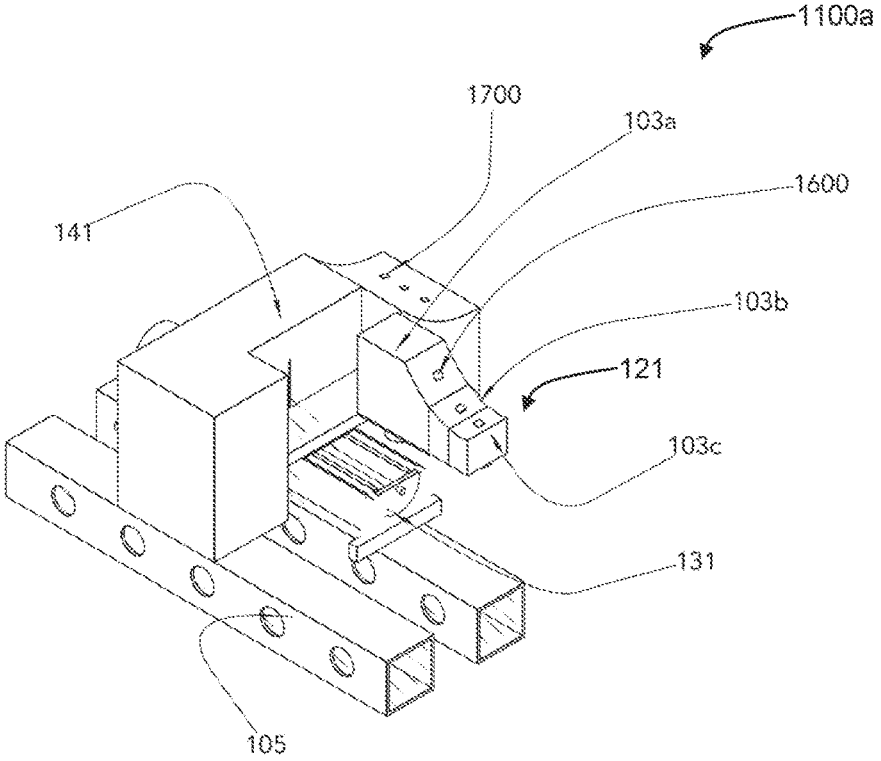
FIG. 13 is an isometric cross-section of a top quarter (head) section of the head position system of the reconfigurable proning bed.
Figure 14:
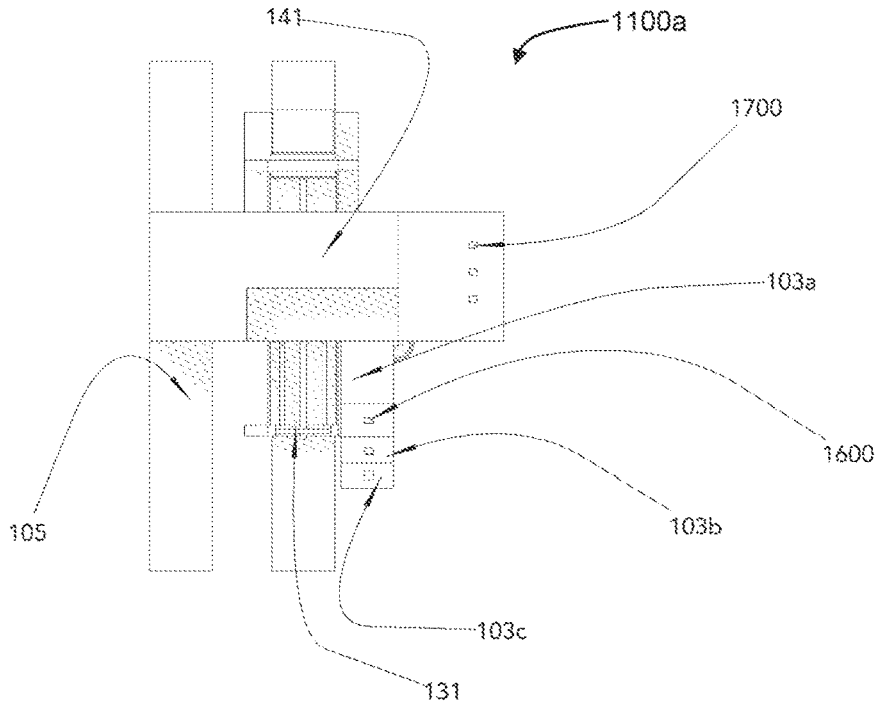
FIG. 14 is a top view of the top quarter (head) section of the head position system of the reconfigurable proning bed.
Figure 15:
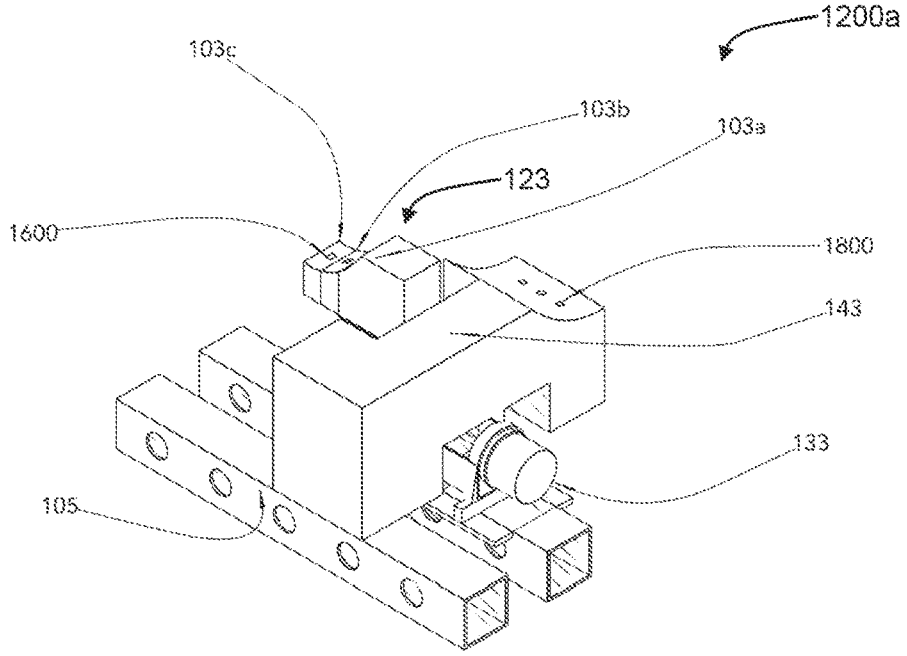
FIG. 15 is an isometric cross-section of a lower quarter (chin) section of the head position system of the reconfigurable proning bed.
Figure 16:
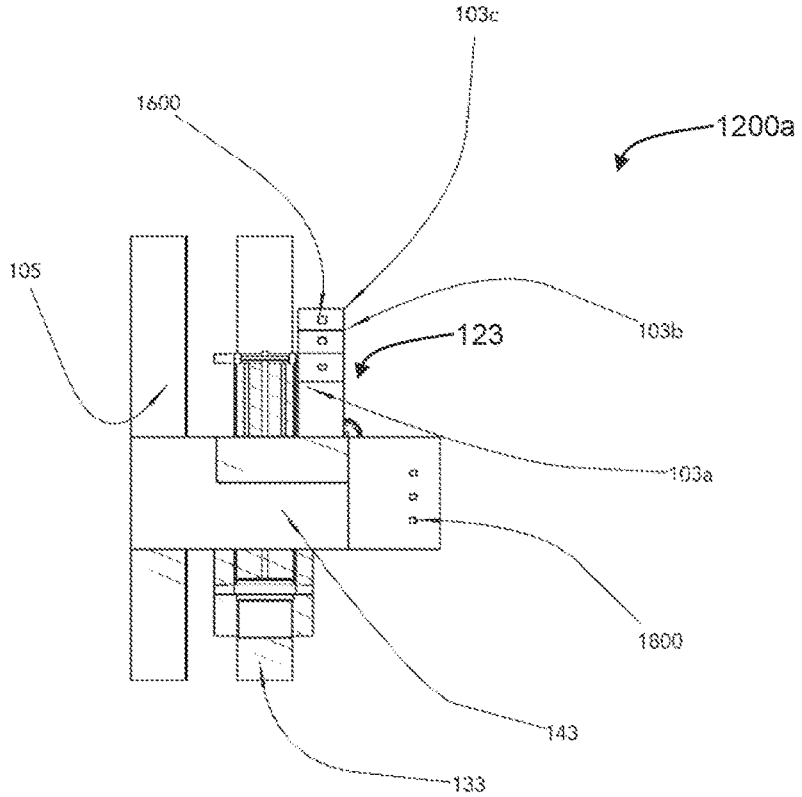
FIG. 16 is a top view of the lower quarter (chin) section of the head position system of the reconfigurable proning bed.

FIG. 13 is an isometric cross-section, FIG. 14 is a top view, showing a top (head support) quarter of the HPS 100, FIG. 15 is an isometric cross-section, and FIG. 16 is a top view showing a lower (chin support) quarter of the HPS 100. The two quarter views of the head support 1100*a* and chin support 1200*a* of the HPS 100 include the L-shaped foam pillow 141 and 143, respectively, with curved sections to support the forehead and the chin. The HPS 100 also includes the sensors 1700 on the top of the curved sections of the two head supports 1100*a* and 1100*b* to detect forehead position, and the sensors 1800 on the curved lower sections of the chin supports 1200*a* and 1200*b* to detect the chin position. The HPS 100 also includes the I-shaped FS 121, 122, 123 and 124 located near the middle hole and actuated to rotate 90 degrees by servo motors 106*a*. The HPS 100 also includes the linear motors 131, 132, 133 and 134 located under the L-shaped pillows, which actuates by moving forward or backward to provide an appropriate reconfigurable size of the hole, as described herein.

The HPS 100 is activated based on the inputs received from the sensors 1700 and 1800 of the curved sections. In some cases, the HPS is initiated as the patient put his forehead on the upper section of the HPS 100, i.e., the head support sections 1100*a* and 1100*b*. The sensors 1700 of the head support sections 1100*a* and 1100*b*, receive the inputs from the patient's forehead, and accordingly activate the chin support sections 1200*a* and 1200*b*. As shown in FIG. 13 and FIG. 14 there are three locations for the sensors 1700 on the head support section 1100*a* and 110*b* to accommodate the different patients' face sizes, i.e., for kids, teens, and adults.

As the sensors 1700 detect the head position, the lower section (chin support section) 1200*a* and 1200*b* of the HPS 100 actuate the linear actuators 133 and 134 to move forward or backward by incrementally moving the chin support section 1200*a* and 1200*b* forward or backward until the sensors 1800 detect the chin position and stop further movements. The four I-shaped FS are originally embedded inside the pillows. Then, the linear actuators will stop moving, and based on the distance between the head support section and the chin support section, the central controller will use this distance to have one of more sections 103*a*, 103*b*, and/or 103*c* of the FS 121, 122, 123 and 124 activated to support the face if decided to move to the side while proning. The FS 121, 122, 123 and 124 has three sections each 103*a*, 103*b* and 103*c*; these sections are attached or detached using magnetic plates between them.

Figure 17:
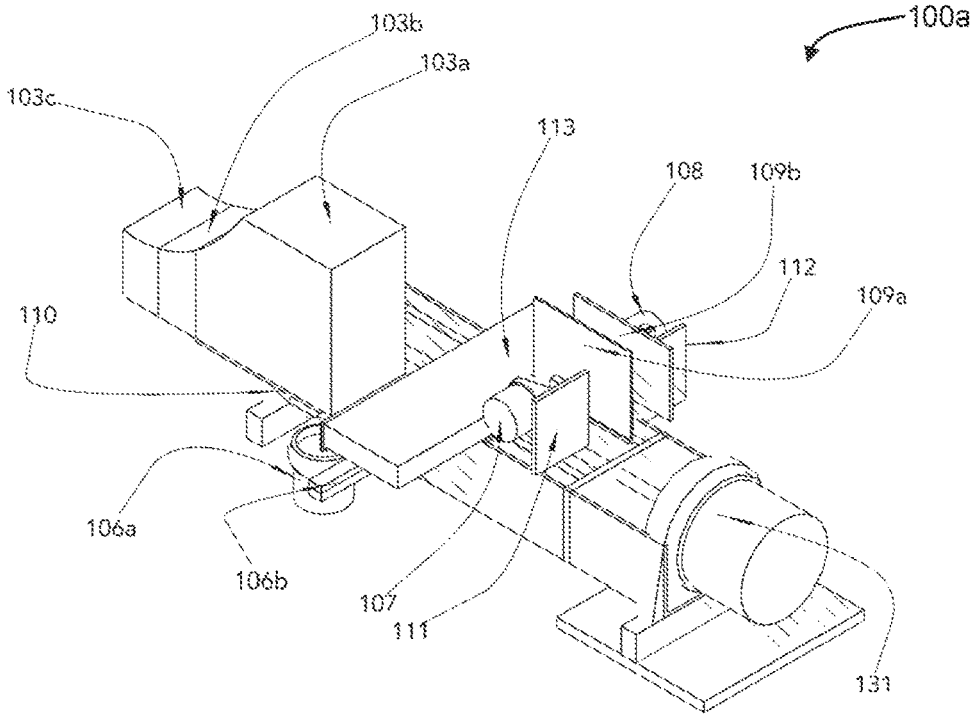
FIG. 17 is an isometric back view of the quarter section after removing a U-shaped foam piece and showing inner architecture of the head position system of the reconfigurable proning bed.

In an embodiment, each of the four FS 121, 122, 123 and 124 include three sections 103*a*, 103*b*, and 103*c*. Two of these sections can be detachable portions 103*b* and 103*c*. The detachable portions 103*b* and 103*c* are originally attached to the rotating section 103*a* using magnetic plates in between them. To have the two portions 103*b* and 103*c* detached to reach the required length identified previously, one of the two separating plates 109*a* and 109*b* are actuated using one of the two servo motors 107 and 108, allowing the plates to rotate 90 degrees to create separators between the portions. The separating plates and the two servo motors are located inside the L-shaped section 101, as illustrated in FIG. 17 and FIG. 19. The detachable portions create three different lengths to support different sizes of the patient's face while proning, based on the face size and the distance between the HPS head and chin sections. In a particular case, the detachable portions can be comprised of foam and connected using magnetic and metal plates. When the L-shaped pillows 141, 142, 143 and 144 are less than the length of the FS portion 103*a*, the I-shaped FS pillow 121, 122, 123 and 124 can rotate to its default location inside the L-Shaped pillows.

In an example, the patient puts his head on the top curved sections of the L-shaped pillow 141 and 142 looking downward. The force and/or position sensors 1700 located on the top of the curved sections receive a weight indicating the patient's face position. In response, the microcontroller 7005 in communication with the central controller 1400 instructs actuation of the two linear motors 133 and 134, which move the chin support section forward until the sensors 1800 located on the lower curved sections detect the patient's chin. The microcontroller 7005 thus stops the four motors 131, 132, 133 and 134 at a suitable time, creating an appropriate size of the hole based on the size of the patient's face. In an example, if the EPS system 200 detects the patient's eyes using the two or more cameras 206, the I-shaped FS 121, 122, 123 and 124 will stay in their default positions inside the L-shaped pillow 141, 142, 143 and 144. In other cases, where the cameras 206 do not detect the patient's eyes, the four I-shaped portions 121,122, 123 and 124 will actuate based on the distance between the head and chin support sections of the HPS 100. The HPS 100 will actuate the inner separating plates 109*a* and 109*b*, based on the distance needed between the head support sections 1100*a* and 1100*b* and chin support sections 1200*a* and 1200*b*, allowing the I-shaped to accommodate the rotating portion 103*a*, 103*b* and/or 103*c*. The metal separators 109*a* and 109*b* are actuated using two servo motors 107 and 108, in each quarter of the HPS 100. The separating metal plates will act as deactivators of the magnetic plates between the three rotating portions 103*a*, 103*b* and 103*c*. Thus, the length of the FS 121, 122, 123 and 124 will change based on the size and position of the patient's face. Accordingly, the patient will be able to rest his face on the side either to the right or to the left, on the I-shaped FS 121, 122, 123 and 124.

Figure 18:
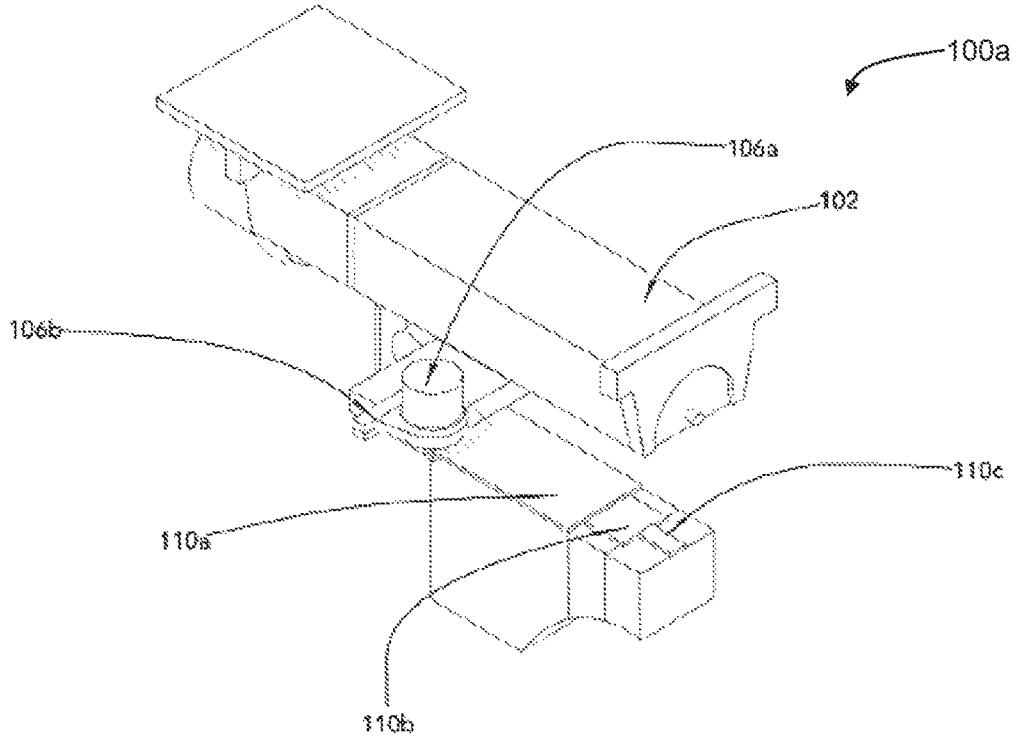
FIG. 18 is an isometric inverted view of the quarter section.

FIG. 17 is an isometric back view showing inner components for quarter of the HPS 100. In this view, the L-shaped pillow 141 has been removed to show its internal structure, including two servo motors 107 and 108 and supporting architecture 113, and two metal plates 109*a* and 109*b* used to detach the I-shaped FS components 103*b* and/or 103*c*. In addition to showing the linear motor 131 used to actuate the HPS, and the servo motor 106*a* can be used to rotate the I-shaped FS 121 portions 103*a*, 103*b* and 103*c* and its supporting metal plate 110. FIG. 18 is an isometric inverted x-ray view showing a quarter of the HPS 100. This view illustrates supporting metal plates 110*a*, 110*b* and 100*c* at the bottom of the I-shaped FS components 103*a*, 103*b* and 103*c*, respectively. FIG. 19 is a top view showing the quarter of the HPS 100.

FIG. 20 is an isometric view and FIG. 21 is a top view of the entertainment position system (EPS) 200. The EPS 200 comprises a modified support system 250, of the APS RSS supporting system 301, to mechanically adjust the location and the inclination of the EPS 200. The modified support system 250, as illustrated in FIG. 22 and FIG. 23, is similar to the RSS used to support and move the APS and LPS but modified with the addition of two connecting metal members 255 and a lower added linear actuator 215, two metal channels 257 to allow the movement of the RSS back and forth, and an added upper servo motor 214 with its supporting architecture 215*a*, 215*b* and 216. The modified RSS can be activated by various sensors, for example, two cameras 206 and 207 for eye detection and two proximity sensors 209 and 210 on the top side of a screen 208. The sensors are used to actuate both the upper servo motor 214, the RSS linear actuator 215 and RSS hydraulic/linear actuators 256*a* and 256*b* at the bottom of the EPS. The sensors are connected to the two microcontrollers 7006 and 7007 which are connected to the central control system 1400 using a wired connection via the bottom frame 1500 or a wireless connection (e.g., Bluetooth™).

In some embodiments, the EPS which provides an entertainment system, initiated by the cameras 206, 207 and the proximity sensors 209, 210, and actuated using the modified support system 250. The EPS includes the touchscreen 208 that includes one or more actuators 214, that can be used to have the touchscreen following the patient's eyes while proning, as described herein. The modified support system 250 can be used to adjust the angle, level and location of the touchscreen for better viewing. The touchscreen 208 can be actuated automatically by a servo motor 214, or in some cases, manually actuated by a user via provided inputs.

FIG. 22 is an isometric view of the positioning system for the touchscreen to automatically reconfigure and adjust the touchscreen orientation using the upper section of the modified support system of the EPS. The touchscreen is located on the top of the modified support system and includes the sensors described above, the servo motor 214 which includes an axial coupling and is supported using a metal mounting bracket 215*b* and 215*a*. A flat plate 216 is attached to the axial shaft and connected to the axial coupling. The axial shaft is connected to a bearing gear supported using the metal mounting bracket 215*a* on a top plate 217*a*. The touchscreen is supported on the flat plate 216. The touchscreen is activated using various sensors or can be manually modified using the touchscreen interface, sending the inputs to the local microcontroller 7007 (as illustrated in FIG. 20 and FIG. 21) connected to the central controller 1400 in order to actuate the servo motor 214.

FIG. 23 is an isometric view of the modified support system 250, which consists of upper 219 and lower structures 258, a linear actuator 215, two hydraulic actuators 256*a* and 256*b*, and two closed-loop linkages 259*a* and 259*b*. The two linkages 259*a* and 259*b* are located inside two channel tubes 257 allowing the system to move forward and backward. The tubes allow the linkages 259*a* and 296*b* to slide back and forth based on the directed movements as described herein. The two linkages are supporting two upper plates 217*a* and 217*b*, as illustrated in FIG. 20, which are supported on four sliding tubes 218*a*, 218*b*, 218*c*, and 218*d*. The two plates 215*a* and 215*b* are used as the supporting base for the servo motor 214 and its support architecture, which accordingly is supporting the touchscreen 208, as illustrated in FIG. 22. The modified support system 250, as described herein, is used to adjust the height and inclination of the EPS.

The modified support system 250 includes two connecting members 255 welded to the base of two closed-loop linkages, allowing them to move horizontally together. Each closed-loop linkage and the actuator 256*a* or 256*b* are connected using two horizontal hollow tubes, one per each linkage. The tube is placed inside a sliding track 257, allowing the linkages to slide back and forth. A linear actuator 215 can also be added to the bottom of the system to move the linkages back and forth. The linear actuator 215 is supported using two metal mounting brackets 252 which are supported on U-shaped metal brackets 253. The two U-shaped brackets 253 are connected by two metal plates 254. While FIG. 23 illustrates the case where the touchscreen level is flat, other possible and suitable inclinations can be used depending on the cameras and proximity sensors. While the present embodiments describe a touchscreen as part of the EPS, it is understood that any suitable type of screen or entertainment device can be used.

On one embodiment, the cameras 206 and 207 and/or the proximity sensors 209 and 210 detect the location and direction of the eyes of the patient. The microcontroller 7006 receives the sensing data and actuates the modified supporting system 250. The modified supporting system 250 will actuate both the linear actuator 215 and the linear/hydraulic actuators 256*a* and 256*b* so as to move the EPS system back and forth, and/or move it upward or downward, and/or incline as directed. Based on the eyes' direction detected by the two cameras, the modified RSS system 250 will actuate the linear actuator 215, which will move the two horizontal tubes inside the channel tubes 257 to a predetermined reading and watching distance; for example, a position at 10-15" away from the patient's eyes and at 60 degrees or less inclination. Then, the two actuators 256*a* and 256*b* will actuate to move upward and downward, allowing the upper section to move accordingly. Once the lower section of the system is adjusted, the camera will continue detecting the eyes' direction, which is connected to the local microcontroller 7007, and thus activating the upper servo motor 214 to rotate the TS 208 to follow the eyes' movements for substantially improved reading and watching directions.

FIG. 24 is an isometric view of a back headboard 600 of the reconfigurable proning bed 50. It comprises a metal frame covered by an aluminum metal sheet 601, a primary touchscreen 1009, two proximity sensors 1021 and 1022, a local microcontroller 7014, and a headboard user touchscreen unit 1008. The microcontroller 7014 is connected to the central controller 1400 using wired connection via the bottom frame 1500 or a wireless connection (e.g., Bluetooth™). The primary touchscreen 1009 can be connected to a caregiver's computing system via wireless connection (e.g., Bluetooth™), which can be used to display various patient related information (such as vital signs) and can be used as an input screen for the different reconfigurable proning bed 50 components and systems. The headboard user touchscreen unit 1008 can be connected to the central controller 1400 via a wired connection or wireless connection (e.g., Bluetooth™), which can be used as an input to control various aspects, such as for adjusting the inclination of the upper and lower sections of the BPS system 700. In some cases, the two proximity sensors 1021 and 1022 detect the proximity of the caregiver, for example at a distance of 90 inches, from both the right or the left side of the bed, respectively. The microcontroller 7014 receives the sensing data and activates the primary touchscreen 1009, allowing the caregiver to view patient's health records, to control the bed different components, and/or change the mode of operation. The headboard user touchscreen unit 1008 can also be used as a quick user-input interface for selecting the mode of operation.

The headboard 600 can be supported on the main bed structure by two metal U-shaped brackets 602. In some cases, the sides of the bed can be finished with aluminum metal cladding sheets 1200 and 1300, and supported on two transverse structural beams 1100 raised on two electromechanical wheels for each beam. The four wheels can be locked by default using an electromechanical system unless deactivated by the control unit.

FIG. 25 is an isometric view of the reconfigurable proning bed 50 in a configuration having two primary mattresses 770 and 780, four secondary mattresses 303*a*, 303*b*, 304*a*, and 304*b* used for the APS, and two tertiary mattresses 403*a* and 403*b* used for the LPS. The primary mattress comprises two separate sections, the upper section 770 and the lower section 780. In some cases, these can be made of foam mattresses that are supported on four supporting systems 701*a* and 701*b* and 801*a* and 801*b*, similar to the RSS used for the APS and the LPS, as in FIG. 4. The primary mattress includes seven holes, one hole for the head, two holes for the upper part (shoulder to elbow) of the arms at the upper section, two holes for the lower part (elbow to hand) of the arms and two holes for the legs on the lower section. The six other mattresses of the APS 303*a*, 303*b*, 304*a*, and 304*b* and LPS 403*a* and 403*b* can be foam mattresses supported on six support systems 301*a*, 301*b*, 302*a*, 302*b*, 401*a* and 401*b*, as in FIG. 4. The two primary mattresses 770 and 780 include a mattress control unit 900, for example, on the top of the upper mattress 770. In some cases, the mattress control unit 900 is a specially designed extruded arrow-shaped foam component acting as a controlling unit to receive input to change the BPS inclination and embedded with force and/or position sensors activated by the patient's hands while proning.

Four other mattresses can be used for the arms 303*a*, 303*b*, 304*a*, 304*b* and can include specially designed extruded arrow-shaped foam components acting as controlling units 1002, 1003, 1004, and 1005. The arrow-shaped foam components are embedded with force and/or positions sensors activated by the patient's hands while proning. The arrows are designed to be easy for the patient to feel by his/her hands while proning. The RSS system 301*a*, 301*b*, 302*a* and 302*b* will move the APS upward and downward and incline as needed. Four rows of the arrow-shaped components can be included to accommodate the different patients' heights, i.e., for kids, teens, and adults.

Two other mattresses can be used for the legs 403*a* and 403*b* and can include specially designed extruded arrow-shaped foam components acting as controlling units 1006 and 1007. The arrow-shaped foam components are embedded with force and/or position sensors activated by the patient's legs while proning. The arrows are designed to be easy for the patient to feel by his/her legs while proning. The RSS system 401*a* and 401*b* will move the LPS upward and downward and incline as needed. Four rows of the arrow-shaped components are included to accommodate the different patients' heights, i.e., for kids, teens, and adults.

The inner sides of the bed can be finished with aluminum metal cladding sheets 305*a*, 305*b*, 404*a*, and 404*b*.

FIG. 26 and FIG. 27 are two isometric views of the side rails position system (SRPS), i.e., the left SRPS 500 and the right SRPS 510. The left SRPS 500 includes a side rail including, in some cases, a safety board 501, the left supplemental touchscreen 502, two cameras 503*a* and 503*b*, two linear and/or hydraulic actuators 506*a* and 506*b* to move side rails upward and downward, which are supported on cylindrical brackets 504*a*, 504*b*, 505*a*, and 505*b*, and a local microcontroller 7008. The local microcontroller 7008 is connected to the central controller 1400 using a wired connection or a wireless connection (e.g., Bluetooth™). The right SRPS 510 includes a side rail including, in some cases, a safety board 511, the right supplemental touchscreen 512, two cameras 513*a* and 513*b*, and two linear and/or hydraulic actuators 516*a* and 516*b* to move side rails upward and downward, which are supported on cylindrical brackets 514*a*, 514*b*, 515*a*, and 515*b*, and a local microcontroller 7009. The local microcontroller 7009 is connected to the central controller 1400 using a wired connection or a wireless connection (e.g., Bluetooth™).

The SRPS can be linked to the HPS, and when the HPS cameras detect the patient's eyes; for example, via face detection and eye movement techniques such as blinks, pupil center corneal reflections (PCCR), and the like. The microcontrollers 7008 and 7009 receive the sensing data that a patient is using the prone bed and actuates the four SRPSs linear/hydraulic actuators of the right SRPS 510 and the left SRPS 500 to move them upward, so as to provide safety for the patient from falling out while proning. In some cases, the touchscreen of the SRPS can be activated for adjusting the levels of the siderails as needed. In some cases, if the patient may prefer to move his/her face to the right side, the camera 503*a* and/or 503*b* will detect the direction of the face based on eye detection, and after, for example, 5 seconds of detecting that the eyes are open, the left supplemental touchscreen 502 will be activated in the direction of the patient's face. The SRPS can then activate another version or copy of the EPS interface on that respective screen. When the patient is sitting, the HPS will not detect the face, and the linear/hydraulic actuators will move up slowly so that the cameras 503*a*, 503*b*, 513*a*, and/or 513*b* can be used to detect the patient's forehead and/or hair, accordingly will stop moving upward; then the cameras will check eyes' direction and thus activate the left and right supplemental touchscreens 502 or 512 based on the direction of the patient's face, allowing the patient to interact with the interface, which can be a copy of the entertainment system used for the EPS.

FIG. 28 is an isometric view of the different sensors that can be used to activate the BPS, and the APS and LPS sections. The BPS 700 components can be activated by, for example, touching, tabbing, clicking, pressing, and/or hovering over the illustrated arrow-shaped components 900. For the upper and lower mattresses 770 and 780, the arrow shaped input components can include force, position and/or push-buttons sensors. These sensors can activate the BPS RSS systems 701*a*, 701*b*, 801*a* and/or 801*b* to move the upper and lower BPS 700 sections upward or downward, using the arrow-shaped components 3003 and 3005. In other cases, the sensors can be used to incline to the right or to the left, and/or incline to the front or to the back (for example, by double touching, tabbing, clicking, pressing and/or hovering over a middle portion 3001 and then moving toward to lower portion 3003 or upper portion 3005). The upper and lower parts of the BPS system can be moved together or separately, for example, by having a long touch, tab, click, press, and/or hove over the middle portion 3001. In some cases, this can produce a sound, voice, and/or haptic response to the sensor portions separately or all together as needed.

For the force, position, and/or push-button sensors used to activate the four mattresses of the APS 303*a*, 303*b*, 304*a*, and/or 304*b*, the sensors can activate the supporting systems 301*a*, 301*b*, 302*a*, 302*b*, as in FIG. 4, to move the four mattresses upward using the arrow-shaped components 3006*a*, 3006*b*, 3008*a*, and 3008*b*, or downward using the arrow-shaped components 3007*a*, 3007*b*, 3009*a*, and 3009*b*. The sensors can also be used to incline to the front or to the back by, for example, by double touching, tabbing, clicking, pressing and/or hovering over the APS's arrow-shaped buttons. The upper and lower APS sections 301 and 302 can be moved together or separately, by having a long touch, tab, click, press, and/or hover over the APS's arrow-shaped buttons. In some cases, this can produce a sound, voice, and/or haptic response to the sensor portions separately or all together as needed. This activation of the supporting systems 301*a*, 301*b*, 302*a*, 302*b* can allow the APS system to automatically adjust, as described herein, the level and inclination based on pre-programmed settings by the caregiver for better circulation of the blood to the hands or allow the patient to have more control of his arm positions and inclinations for reducing the numbness, muscles fatigue, among other long-term discomforts caused by the prone position.

For the force, position, and/or push-button sensors used to activate the two mattresses of the LPS 403*a* and 403*b*, the sensors can activate the supporting systems 401*a* and 401*b*, as in FIG. 4, to move the two mattresses upward using the arrow-shaped components 3010*a* and 3010*b*, or downward using the arrow-shaped components 3011*a* and 3011*b*. The sensors can also be used to incline to the front or to the back by double touching, tabbing, clicking, pressing and/or hovering. The LPS supporting systems 401*a* and 401*b* can be moved together or separately, by having a long touch, tab, click, press, and/or hover over any of the LPS's arrow-shaped buttons. In some cases, this can produce a sound, voice, and/or haptic response to the sensor portions separately or all together as needed. Thus, allowing the LPS system to automatically adjust the level and inclination based on pre-programmed settings for better circulation of the blood to the legs, or allow the patient to have more control on his leg positions and inclinations for reducing the numbness, muscles fatigue, among other long-term discomforts caused by the prone position.

In some cases, the patient or the caregiver can have all eight mattresses, described above, be all at the same level and/or have the same inclinations, by touching, tabbing, clicking, pressing and/or hovering using any two arrow-shaped buttons of the mattress control unit 900, and then moving it to the desired location and/or inclination. In some cases, the system can also have a default level and horizontal position for the BPS, the APS and LPS, which can be reset by, for example, pressing 3001 for 10 seconds.

FIG. 29 is a perspective view showing the reconfigurable proning bed 50. The caregivers, based on the current protocol, can move the patient from another bed and put the patient in the prone position on the bed 50. Once the patient's head reaches the top curved part of the HPS, the control unit can be configured to recognize that the size of the patient' face. The HPS detects the patient forehead size using the force and/or position sensors on the top curved section. Accordingly, the HPS starts to use the inputs to actuate its different actuators to adjust the head support for the patient. The patient's forehead and chin can be positioned by the HPS, allowing the appropriate hole for the eyes, nose, and mouth to breathe.

The four FS 103 can start to rotate 90 degrees, and after they have adjusted their lengths using the separating metal plates, which are used to detach the I-shaped FS components. Accordingly, smaller users can easily move their face to any side or down through the hole. At the same time, the SRPS system 500 starts to move the four side rails upward to keep the patient safe while proning.

The primary touchscreen 1009 on the back headboard can be automatically turned on. A Bluetooth™ can be connected to the patient records and/or patient's smart device and also connected to the EPS 200. External fasteners can be used to connect different medical devices and tubes when needed, which are attached to the main structure and associated info can be displayed on the screen 600.

Advantageously, the patient can change his/her position at any time. In an example situation, the patient can decide to incline his/her upper portion of the torso (e.g., chest), lower portion of the torso (e.g., chest to abdomen or hip), upper portion of the legs (e.g., hip to knee) and head toward the headboard, he/she touches the control unit 900 toward the top part of the upper BPS 700. The BPS 700 takes his/her inputs, such as through the sensors and sends them to the local microcontroller 7010 and 7011, illustrated in FIG. 5 and FIG. 6. The local microcontrollers 7010 and 7011 connect to the central controller 1400 using a wired connection via the bed's bottom frame 1500 or a wireless connection (e.g., Bluetooth™). These can then cause actuation of the upper RSS system 701*a* and 701*b* and the same for the lower RSS system 801*a* and 801*b* via similar system with its own microcontrollers 7012 and 7013. The RSS system changes the bed inclination toward the headboard, while the APS and LPS are still horizontal. The patient may feel that his/her arm is not resting well and decides to touch the arrow-shaped controllers. The RSS system 301*b* and

302*b* of the left APS system and the RSS system 301*a* and 302*a* of the right APS system respond by changing the inclinations toward the end of the bed, i.e., an opposite inclination to the bed mattress direction, as illustrated in FIG. 29. The patient, after few minutes, may then decide to watch something displayed on the EPS 200. As he/she moves their head, the EPS cameras and proximity sensors can be used to actuate the EPS to allow the patient to watch at a reasonable distance and position. In some cases, a voice-controlled EPS can be used to interact with the patient. After some time, the patient may decide to move his/her face to the side and rest on the FS 103. The EPS can detect that the patient is no longer looking and turn off screen 208 and instead activate one of the SRPS 500 supplemental touch-screens 502 or 512. The patient can then continue to interact with the side screen.

Further in the example situation, as illustrated in FIG. 30, the patient can decide to change the inclination of the upper and lower sections of the BPS 700. The RSS 701*a* and 701*b* of the BPS 700 respond by changing the inclination toward the headboard of the bed, and the RSS 801*a* and 801*b* of the BPS 700 respond by changing the inclination toward the end of the bed. The patient can decide to reposition his/her left leg by touching the arrow-shaped controllers. The RSS 401*a* and 401*b* of the LPS system responds by changing the inclination toward the upper section of the bed. Also, by touching the arrow-shaped controllers on the APS, the RSS (301*a* and 302*a*) and (301*b* and 302*b*) of the right and left APS starts to respond by changing the inclinations, as illustrated.

Referring now to FIG. 31, an example of a method for reconfiguring a proning bed 2700 is shown. At block 2702, the HPS 100 senses a size and a position of a patient's head who is positioned in prone position of the reconfigurable bed. At block 2704, the HPS 100 uses actuators to position pillow components to support the patient's head. At block 2706, the four SRPS actuate by moving upward to safely secure the patient from falling out of the proning bed 50. At block 2708, the EPS detects the direction of the eyes of the patient to determine if the patient is looking down or to one of the sides.

At block 2710, where the EPS detects that the patient is looking down, the EPS initiates. At block 2712. EPS receives the face location and eye direction of the patient. At block 2714, the modified supporting system adjusts the EPS level and inclination of the touchscreen. At block 2716, the EPS system activates the touchscreen interface and receives the patient's input.

At block 2718, where the EPS does not detect the eyes of the patient, the corresponding SRPS interface is initiated based on which direction the user's head is facing.

At block 2720, the BPS 700 receives torso-related inputs using the control unit 900. At block 2724, the BPS 700 uses actuators of the RSS 701*a*, 701*b*, 801*a*, and 801*b* to position an upper section of the BPS and lower section of the BPS to accommodate the patient's upper portion of the torso (e.g., chest), and the lower portion of the torso (e.g., chest to abdomen or hip) and the upper portion of the legs (e.g., hip to knee), respectively.

At block 2726, the APS 300 detects the arms; and, at block 2730, the LPS 400 detects the legs of the patient. At block 2728, the APS 300 uses actuators to position an upper and lower APS (for right and left) to accommodate the patient's arms. At block 2732, the LPS 400 uses actuators to position an upper and lower LPS (for right and left) to accommodate the patient's legs.

FIG. 32 is a diagram illustrating connections of the local embedded microcontrollers with the central controller 1400. The reconfigurable proning bed 50 includes a network of microcontrollers each in communication with the central controller. The components of the reconfigurable proning bed 50 can be activated by the respective microcontrollers connected to the centralized control unit 1400. The local embedded microcontrollers are used as part of a distributed network in the bed's control system, which are performing local processing of sensing (inputs) and actuating (outputs) for the bed's different components to provide autonomy and independence for each component, as described herein. The local embedded microcontrollers can be managed by the central controller, which coordinates the different local microcontrollers in a sequence described herein; for example, as illustrated in FIG. 31. The local microcontrollers include, the left and right SRPS microcontrollers 7008 and 7009, the HPS microcontroller 7005, the headboard microcontroller 7014, the EPS screen's microcontroller 7007, the EPS modified RSS's microcontroller 7006, the upper and lower left BPS reconfigurable systems' microcontrollers 7010 and 7012, the upper and lower right BPS reconfigurable systems' microcontrollers 7011 and 7013, the upper and lower left APS reconfigurable systems' microcontrollers 7001 and 7002, the upper and lower right APS reconfigurable systems' microcontrollers 7003 and 7004, the left and right LPS reconfigurable systems' microcontrollers 7015 and 7016. In further embodiments, the central controller 1400 can be directly connected, or otherwise in communication with, the various connected elements of each system, without requiring the local microcontrollers.

The reconfigurable proning bed 50 is configurable and reconfigurable using many sensors, processors, and actuators, and can have one or two modes of operation: (a) an autonomous mode, and (b) a mode based on user input.

In some cases, in a default configuration, the reconfigurable proning bed 50 is configured in a flat inclination for the HPS, the BPS, the APS and the LPS, and the height of the BPS and HPS are leveled, for example, to 24 inches, and the heights of the APS and LPS are leveled as, for example, 4 inches lower than the BPS height, for example, 20 inches for resting the shoulders and the thigh. Additionally, the reconfigurable proning bed 50 is in the autonomous mode unless deactivated by interacting with one of the interfaces, or through the headboard user touchscreen unit 1008.

The different bed automatic configurations can be preprogrammed, to be the default, at any time by the medical staff, using Bluetooth™ to be connected to proprietary software, based on developed research on best blood circulation and psychological factors affecting patients while proning.

In the autonomous mode, the reconfigurable proning bed 50 can detect the patient's head, arms, legs, and eyes using sensors, as described herein. The sensors will send the inputs to the central controller 1400. The reconfigurable proning bed 50 uses multiple actuators, as described herein, which can be used to automatically reconfigure the different bed components; thus providing one of multiple scenarios to reposition the torso, arms, and legs for better blood circulation, as exemplified in FIG. 29 and FIG. 30.

The actuators either directly position and/or move the reconfigurable components, or indirectly position and/or move the configurable components, by using linkages which are attached to the actuators to allow more degrees of freedom, i.e., to allow different angles for inclination in addition to changing the level/height of the component.

An example of the actuators that directly position and/or move are the HPS 100 configurable components, as illustrated in figures FIG. 10 to FIG. 18. The linear/hydraulic actuators 133 and 134 move the chin support pillow 143 upwards, until the sensors 1800 detects the patient's chin while proning.

Another example of the actuators that indirectly position and/or move the bed's components are the BPS, APS, LPS and EPS configurable components. For the APS, as illustrated in figures FIG. 8, the hydraulic actuators 311*a*, 311*b*, 321*a* and 321*b* are connected to the linkages 312*a*, 312*b*, 322*a* and 322*b*, respectively, to change the level of the APS system upward and downward, and/or to change the inclination (for example, by increments of 5 degrees). The inclination of the APS system can be modified by having one of the actuators 311*a*, 311*b*, 321*a* or 321*b* activated to move upward or downward, allowing the respective linkages 312*a*, 312*b*, 322*a* and 322*b* to change their heights and accordingly change the APS inclination. In some cases, the user-input sensors illustrated in FIG. 28 detect the patient's inputs for the level and inclination of the BPS, APS and LPS systems.

An example of the autonomous mode configuration of the reconfigurable proning bed 50 is an autonomous mode entitled 'AM-01'; which is one of many configurations that can be pre-programed by a suitable person or caregiver prior to the patient using the reconfigurable proning bed 50. For the AM-01 example, the reconfigurable proning bed 50 is automatically configured without the need for user-inputs, providing a convenient setting for ARDS patients, and more practical in case of emergency, as in pandemic times. The AM-01 example includes autonomous features of the HPS, BPS, APS, LPS, SRPS and EPS, as described herein.

In the AM-01 example, the HPS 100 autonomous features allow for adjusting the hole size between the forehead and the chin to accommodate the different sizes of patient's heads, i.e., kids, teens and adults; and, providing face supports when needed, i.e., patient moving his/her face to the sides. In some cases, the caregivers help the patient to prone by putting the patient's forehead on the forehead sections 1100*a* and 1100*b*, then automatically, the HPS detects the patient's forehead using the sensors 1700. Thus, the automatic mode is directly activated once the forehead is detected using the sensors 1700.

After the sensors 1700 detect the patient's forehead, the chin sections 1200*a* and 1200*b* of the HPS 100 will automatically move forward using the linear actuators 133 and 134. The HPS chin section will move slowly until the patient's chin is providing a force into the sensors 1800, which means that the HPS is now ready for accommodating this patient. The HPS 100 automatically adjusts the size of the hole between the forehead sections 1100*a* and 1100*b* and the chin sections 1200*a* and 1200*b*. Also, in some cases, the HPS 100 can automatically keep the FS 121, 122, 123 and 124 in their default position inside the L-shaped foam pillows or activate their actuators to provide a side support for the face.

In some cases, another autonomous feature of the HPS 100 is the face support system FS 121, 122, 123 and 124 which is designed to accommodate the patient's face when looking to either the right or the left sides while proning, by rotating the FS at 90 degrees. In order to determine the direction of the face, the FS system is activated based on the inputs received from the EPS's two cameras 206 and 207, and/or the inputs received from at least one of the four cameras 503*a*, 503*b*, 513*a*, and/or 513*b* of the SRPS. When the two cameras of the EPS are not detecting the presence of the patient's eyes, and one or more of the four cameras of the SRPS system detects the patient's eyes, the FS system will activate.

The FS system is activated when one or more of the six cameras of the EPS and/or the SRPS detect the presence of the patient's eyes. Then, the central controller 1400 process the data received from the movement of the linear actuators 133 and 134 of the HPS 100, and determines the distance between the forehead and the chin support sections. In some cases, the default position of the FS is inside the L-shaped foam pillows. The automatic activation of the FS has two steps: (1) automatically adjust the length of the FS by activating or deactivating one or more portions 103*a*, 103*b*, and/or 103 using the inner servo motors 107 and/or 108, and (2) automatically rotate the FS at 90 degrees to providing support to the face.

In the AM-01 example, the SRPS 500 can have autonomous features, which can be linked to the HPS. Once the HPS detects the patient's face by using the sensors 1700, as described herein, the central controller 1400 can activate at least one of the four SRPS, which will automatically actuate the respective hydraulic actuators 506*a*, 506*b*, 516*a* and 516*b* to move upward to the full height of the SRPS. The SRPS can also autonomously activate one of the two supplemental touchscreen interfaces 502 and 512. The activation for one of the two interfaces are following the detection of the direction of the patient's eyes using one or more of the four SRPS cameras 503*a*, 503*b*, 513*a* and/or 513*b*. Accordingly, the central controller processes the received inputs from the sensors to activate the corresponding SRPS interface in the direction of the patient's face. The SRPS automatically activates another version or copy of the EPS interface on that respective screen.

In the AM-01 example, the EPS 200 can have autonomous features which can help in reducing the short-term and long-term discomforts in this unusual position, i.e., proning. The EPS system is activated when one or both cameras 207 and 210 detect the patient's eyes. The cameras will send their inputs to the central controller 1400 to process them. The cameras detect both the presence of the eyes, if they are open or closed, and they also detect the directions of the eyes. The inputs will be processed and accordingly activate or deactivate the EPS system.

Since the EPS is activated based on the presence and openness of the eyes, the EPS which provides an entertainment system to follow the eyes' directions and provide an appropriate distance for watching or reading through the touchscreen 208. The EPS can be initiated by the sensors 206, 207, 209, and/or 210. Following the eyes' movements detected by the two cameras, the EPS is automatically actuated to move forward and backward using the linear actuator 215. The EPS will automatically provide an appropriate distance of, for example, 10-15 inches for watching or reading as detected using the proximity sensors 209 and 210. Then the EPS can adjust the height of the screen by the vertical movements of the hydraulic actuators 256*a* and/or 256*b*, which will adjust the heights of the respective two linkages 259*a* and 259*b*.

The EPS will automatically adjust the angle of the screen to follow the eyes' directions, using the two cameras, by employing two degrees of freedom. The first degree of freedom in the X-Z direction is achieved by changing the angle of the upper supporting structure 219, i.e., rotating the system, by moving one or two vertical hydraulic actuators 256*a* and/or 256*b* upward and/or downward, which will adjust the heights of the two linkages 259*a* and 259*b* allowing the interface to rotate and thus following the eyes in the X-Z directions. The second degree of freedom in the Y-Z direction is achieved by actuating the servo motor 214 and axial shaft 216, where the servo motor will rotate based on the eye's directions in the Y-Z direction, rotating the shaft which is holding the screen 208. As the EPS interface screen is activated, it can be configured by using touch or voice or haptic as an input.

The reconfigurable proning bed 50 in the autonomous mode can be reconfigured to change the upper and the lower mattresses heights and/or inclinations, the APS height and/or inclination, and the LPS height and/or inclination. These three reconfigurable components and their subcomponents, as described herein, can be preprogramed by the medical staff and actuated once a patient is present in bed. The default height of the reconfigurable proning bed 50 can be configured, for example at 20 inches. In some cases, the BPS, the HPS, the APS and the LPS are horizontally flat by default. Once the HPS detects a patient in place, using the forehead sensors 1700, the reconfigurable proning bed 50 will automatically change its height upward to reach a predetermined height, for example 24 inches. Accordingly, the upper RSS 701*a* and 701*b* of the BPS, the lower RSS 801*a* and 801*b* of the BPS, the upper APS RSS systems 301*a* and 301*b*, the lower APS RSS systems 302*a* and 302*b*, and the LPS RSS systems 401*a* and 401*b* can automatically actuate their vertical hydraulic actuators to adjust the heights and inclinations for the head, torso, arms and legs based on pre-programmed settings.

Advantageously, the present embodiments provide an autonomous bed for ARDS patients without the need for user-inputs or excessive precautions.

In the user-input mode, the patient and/or the caregiver may interact with the bed through any of the interfaces, i.e., the back headboard's primary touchscreen interface 1009, any of the two side rails position system's touchscreen interfaces 502 and 512 on the respective right and left side rails system, and the entertainment position system's touchscreen interface 208.

In most cases, the HPS 100, the EPS 200, the SRPS 500, and the SRPS 510 can remain autonomously reconfigurable, as described herein. While the BPS 700, the APS 300, and the LPS 400 can be reconfigurable by user inputs through one or more of the bed's interfaces, described herein.

In some cases, as a patient or caregiver comes close to the bed, the primary touchscreen 1009 of the back headboard can be activated using two motion sensors 1021 and 1022. The primary touchscreen 1009 interface is activated and requests inputs from the caregiver to either continue in the autonomous mode or change to the user-input mode. The headboard user touchscreen unit 1008 can have two push-buttons to activate either modes. In some cases, the push buttons can be sensory inputs to adjust the three bed components, and partially deactivate the autonomous features of these parts of the bed. The sensors of these systems receive the user-input for the desired heights and inclinations of the BPS, the APS, and/or the LPS. These inputs will be directed to the central controller 1400, which then actuate the different RSS systems. The RSS systems are actuated by moving one or more hydraulic actuators, as described herein. Based on the patient's and/or the caregiver's inputs, the reconfigurable heights and inclinations of the RSS systems will provide different configurations for the head, torso, arms and legs of the ARDS patients. Examples of two different configurations are illustrated in FIG. 29 and FIG. 30.

Although the invention has been described with reference to certain specific embodiments, various modifications thereof will be apparent to those skilled in the art without departing from the spirit and scope of the invention as outlined in the claims appended hereto.

The invention claimed is:

1. A reconfigurable autonomous and user-input proning bed to support and accommodate a patient while positioned in prone position, the reconfigurable proning bed comprising:

one or more controllers each comprising one or more processors; and one or more position systems comprising at least one of:

a head position system (HPS) comprising one or more HPS sensors to detect a position of the head of the patient and a plurality of actuated pillow components that are configurable and reconfigurable by the one or more controllers to be automatically positioned to accommodate the position of the head of the patient based on the detected position of the head;

an arms position system (APS) comprising one or more APS sensors, APS upper sections, and APS lower sections, the one or more APS sensors detect the presence of the arms of the patient, and upon detecting the presence of the arms, a level and an inclination of the APS upper sections and the APS lower sections are automatically positioned by the one or more controllers to accommodate the position of the arms of the patient based on pre-programmed or received values for the level and the inclination of the APS upper sections and the APS lower sections;

a legs position system (LPS) comprising one or more LPS sensors, a LPS right section, and a LPS left section, the one or more LPS sensors detect the presence of the legs of the patient, and upon detecting the presence of the legs, a level and an inclination of the LPS right section and the LPS left section are automatically positioned by the one or more controllers to accommodate the position of the legs of the patient based on pre-programmed or received values for the level and the inclination of the LPS right section and the LPS left section; and a body position system (BPS) comprising one or more BPS sensors, a BPS upper section, and a BPS lower section, the one or more BPS sensors detect the presence of the torso of the patient, and upon detecting the presence of the torso, a level and an inclination of the BPS upper section and the BPS lower section are automatically positioned by the one or more controllers to accommodate the position of the torso of the patient based on pre-programmed or received values for the level and the inclination of the BPS upper section and the BPS lower section.

2. The reconfigurable proning bed of claim 1, further comprising an entertainment position system (EPS), the entertainment position system comprising one or more EPS sensors to detect a position of the face of the patient and directions of the eyes, and a plurality of actuated EPS components that are configurable and reconfigurable by the one or more controllers to be automatically positioned to accommodate the position of the face and to follow the direction of the eyes of the patient based on the detected position of the face and the direction of the eyes.

3. The reconfigurable proning bed of claim 2, wherein the plurality of actuated EPS components comprise one or more EPS actuators, one or more displays connected to the one or more EPS actuators, and an EPS control unit to instruct display of visuals on the one or more displays.

4. The reconfigurable proning bed of claim 3, wherein the one or more displays comprise a touchscreen to display visuals and receive inputs.

5. The reconfigurable proning bed of claim 2, further comprising one or more side rail position systems (SRPS), the one or more side rail position systems comprise a side rail on each side of the reconfigurable proning bed, one or more SRPS sensors, one or more SPRS actuators connected to each of the side rails, and one or more displays, the side rails configurable and reconfigurable by the one or more controllers to be automatically positioned to provide safe enclosure for the patient via actuation of the one or more SPRS actuators based on the one or more SRPS sensors.

6. The reconfigurable proning bed of claim 5, wherein the one or more displays comprise a touchscreen to display visuals and receive inputs.

7. The reconfigurable proning bed of claim 1, wherein the actuated pillow components of the HPS define a hole therebetween for receiving the patient's face, and where the actuated pillow components comprises one or more reconfigurable face supports.

8. The reconfigurable proning bed of claim 7, wherein the actuated pillow components of the head position system further comprise one or more pillows with a curved section to support the head and the chin of the patient, wherein the curved section accommodate the HPS sensors.

9. The reconfigurable proning bed of claim 8, wherein the one or more reconfigurable face supports comprise one or more detachable actuated pillows and one or more separating plates, the detachable actuated pillows comprise one or more magnetic plates, the actuated pillow components define one or more holes to receive the separating plates, the separating plates moveable as instructed by the one or more controllers to be positioned to accommodate the size of the face of the patient, wherein the pillows follow the movement of the separating plates due to attraction from the one or more magnetic plates based on the size.

10. The reconfigurable proning bed of claim 1, wherein the one or more position systems comprise both the HPS and the BPS, wherein the HPS is fixed to the BPS upper section, and wherein configuration and reconfiguration of the level and inclination of the head of the patient supported by the HPS can be based on the level and inclination of the upper portion of the torso supported by the upper BPS section.

11. The reconfigurable proning bed of claim 1, wherein the APS comprises upper right, lower right, upper left, and lower left arm sections, the one or more APS sensors detect the presence of each of the arms of the patient, and wherein the level and the inclination of the upper section and the lower section of each the left and right arm sections are separately configurable and reconfigurable by the one or more controllers to reposition the level and inclination of the respective arms of the patient based on the detected presence using APS actuators.

12. The reconfigurable proning bed of claim 1, wherein the LPS comprises a right leg section and a left leg section, the one or more LPS sensors detect the presence of the legs of the patient, and wherein the level and the inclination of each the left leg section and the right leg section are separately configurable and reconfigurable by the one or more controllers to reposition the respective legs of the patient based on the detected presence using LPS actuators.

13. The reconfigurable proning bed of claim 1, wherein the level and inclination of the BPS upper section and the BPS lower section are separately configurable and reconfigurable by the one or more controllers to reposition a respective supported body part of the patient.

14. The reconfigurable proning bed of claim 2, wherein the plurality of actuated EPS components are configurable and reconfigurable by the one or more controllers to be positioned to change the level and inclination of the display to accommodate the preferences of the patient based on input received.

15. The reconfigurable proning bed of claim 5, wherein the plurality of actuated SRPS components are configurable and reconfigurable by the one or more controllers to be positioned to change the level and inclination to accommodate the preferences of the patient based on input received.

16. The reconfigurable proning bed of claim 1, wherein the received values comprise inputs received from a caregiver.

* * * * *